US007005112B1

(12) United States Patent
Takahashi et al.

(10) Patent No.: US 7,005,112 B1
(45) Date of Patent: Feb. 28, 2006

(54) THERMAL DECOMPOSER FOR WASTE

(75) Inventors: Hiroyuki Takahashi, Tokyo (JP); Kiyoe Takahashi, Tokyo (JP)

(73) Assignee: Kyowa Co., Ltd., Tokyo (JP)

( * ) Notice: Subject to any disclaimer, the term of this patent is extended or adjusted under 35 U.S.C. 154(b) by 0 days.

(21) Appl. No.: 09/673,680

(22) PCT Filed: Feb. 18, 2000

(86) PCT No.: PCT/JP00/00943

§ 371 (c)(1),
(2), (4) Date: Oct. 17, 2000

(87) PCT Pub. No.: WO00/48753

PCT Pub. Date: Aug. 24, 2000

(30) Foreign Application Priority Data

Feb. 18, 1999 (JP) ..... 11-082142

(51) Int. Cl.
*B01J 19/08* (2006.01)

(52) U.S. Cl. ..... 422/186.21; 219/69.1

(58) Field of Classification Search ..... 422/186.21, 422/186.22, 186.25; 219/69.1, 121.11
See application file for complete search history.

(56) References Cited

U.S. PATENT DOCUMENTS

| | | | | | |
|---|---|---|---|---|---|
| 5,028,307 | A | * | 7/1991 | Rightmyer | 204/278 |
| 5,095,828 | A | * | 3/1992 | Holden et al. | 110/250 |
| 5,673,285 | A | * | 9/1997 | Wittle et al. | 373/82 |
| 5,762,659 | A | * | 6/1998 | Katona et al. | 48/197 R |
| 5,855,763 | A | * | 1/1999 | Conlin et al. | 205/688 |
| 6,136,063 | A | * | 10/2000 | Brosnan | 75/407 |

FOREIGN PATENT DOCUMENTS

| | | | | |
|---|---|---|---|---|
| CN | 1047006 A | | | 11/1990 |
| EP | 1134041 A | | * | 9/2001 |
| JP | 61-109613 A | | | 5/1986 |
| JP | 9-236239 | | | 9/1997 |
| JP | 10141644 A | | * | 5/1998 |
| JP | 10-36851 | | | 10/1998 |
| JP | 11014022 A | | * | 1/1999 |
| JP | 11148779 A | | * | 6/1999 |
| JP | 11211057 A | | * | 8/1999 |
| JP | 411351534 A | | * | 12/1999 |
| JP | 2000-121018 | | | 4/2000 |
| JP | 2002139211 A | | * | 5/2002 |
| JP | 02003059640 A | | * | 2/2003 |
| JP | 2003071419 A | | * | 3/2003 |
| WO | WO 00/48753 | | * | 8/2000 |

OTHER PUBLICATIONS

A copy of the Chinese Office Action citing the above references.
International Search Report for PCT/JP00/00943.

* cited by examiner

*Primary Examiner*—Kiley S. Stoner
(74) *Attorney, Agent, or Firm*—Young & Basile, P.C.

(57) ABSTRACT

A thermal decomposition apparatus for wastes comprises: a heating chamber; an inlet port; at least one pair of electrodes provided within the heating chamber; a plurality of balls each taking the shape of a sphere whose primary ingredient is carbon, provided between the at least one pair of electrodes so as to produce an electric discharge when a voltage is applied across the at least one pair of electrodes; an outlet port for discharging the gases into which the wastes are thermally decomposed; oxygen free or vacuum environment forming means or evacuating means.

According to the present invention, an inexpensive thermal decomposition apparatus for wastes is provided which thermally decomposes almost all wastes at a high temperature of not lower than about 3000° C. without producing harmful substances such as soot, dust, chlorine compounds; nitrogen compounds and/or dioxin.

16 Claims, 18 Drawing Sheets

THERMAL DECOMPOSER FOR WASTE

BACKGROUND OF THE INVENTION

The present invention relates generally to thermal decomposition apparatus for thermally decomposing various wastes which contain general wastes including polymers of resins, industrial wastes, infectious medical wastes, and chemical substances such as PCBs and waste oils without producing gas containing harmful substances.

In the current society, an enormous amount of wastes are discharged daily and their disposal is a great problem. The wastes include various kinds such as general, industrial and medical wastes. Most of the wastes are processed by burning or burial, which has several problems. The primary problem with the burning process is the production of harmful substances. In the burning process, the wastes are burned with air. Thus, harmful substances such as soot, dust, carbon monoxide and nitrogen compounds, such as $NO_x$, are produced and discharged with other exhaust gas. Since the burning temperature is at about 700–800° C., harmful dioxin is produced and hence exhaust gas and ashes containing dioxin are produced.

The harmful substance content of the exhaust gas is regulated, especially substances such as dioxin, which has a very high toxicity and adversely affects human bodies for a long time.

In order to prevent production of dioxin, the following measures are available:

(1) The wastes which produce no dioxin are segregate from the ones which produce dioxin, and only the ones which produce no dioxin are burned;

(2) A device is used for removing dioxin contained in the exhaust gas discharged from an incinerator and is attached to an incinerator; or (3) An incinerator which burns wastes at a high temperature such that dioxin is difficult to produce (hereinafter referred to as a high temperature incinerator) is used.

There is, however, the problem with the first method in that it takes time and costs considerably more to segregate the wastes. In addition, it is substantially impossible to perfectly separate the wastes and production of a small amount of dioxin cannot be avoided.

The second method is insufficient to cope with dioxin because there are presently no devices capable of completely removing dioxin. Thus, it is insufficient to cope with dioxin. Thus, a secondary incinerator is required for burning dioxin contained in the exhaust gas, a cooling device for rapidly cooling the exhaust gas so as not to reproduce dioxin, and a filter for removing dioxin remaining in the exhaust gas is installed on the incinerator. However, installation of such devices in combination is costly and renders a more complicated incinerator.

As described above, the exhaust gas contains a plurality of harmful substances in addition to dioxin. In order to eliminate them all, a plurality of devices for removing such harmful substances are required to be attached to the incinerator. Thus, the incinerator would become expensive and complicated in structure.

Since the high temperature incinerator is expensive, there is a problem with the third method that it is not easy to replace the old incinerator with a new high temperature incinerator. In addition, it is difficult to completely prevent production of even a small amount of dioxin even with the high temperature incinerator.

Burning the wastes also has problems other than production of the harmful substances. Usually, wastes contain incombustible substances such as metals and glass. Therefore, when the wastes are burned, incombustible materials are produced and required to be removed from the incinerator, which takes much time. In terms of time and cost, it is difficult to segregate the wastes according to material type and then to process the different material types separately.

In addition, there are wastes which contain substantial amounts of incombustible materials, such as industrial wastes and shredder dust, including the remains of car bodies and household appliances. These wastes are not suitable for burning.

The other method for processing wastes is burial. It is becoming increasingly difficult to secure a place where the wastes are to be buried. In addition, there is the problem that chemical substances contained in the wastes will react when buried to resynthesize new chemical (harmful) substances. Furthermore, harmful heavy metals such as lead and/or harmful chemical substances such as dioxin contained in the wastes dissolve in rain to pollute the soil, rivers and ground water (soil pollution, water pollution) and thereby destroy the environment.

Methods appropriate (efficient and safe) for disposal of certain kinds of the wastes, such as PCBs and/or dioxin, have not yet been found and hence these wastes can only be stored and kept. Such wastes may leak out during their storage to pollute the environment and hence further measures are required to be taken.

In order to solve the above various problems, an apparatus capable of disposing of all wastes without producing harmful substances are desired, for example, an apparatus for thermally decomposing the wastes at high temperatures without burning them. However, it is difficult to efficiently obtain high temperatures to thermally decompose all the wastes.

It is therefore an object of the present invention to provide inexpensive thermal decomposition apparatuses for wastes which solve the above problems and which thermally decomposes wastes without producing harmful substances such as soot, dust, chlorine compounds such as hydrogen chloride, nitrogen compounds such as $NO_x$ and/or dioxin.

SUMMARY OF THE INVENTION

In order to achieve the above objective, the present invention provides a heating chamber for heating wastes, an inlet port for introducing the wastes into the heating chamber, at least one pair of electrodes provided within the heating chamber, a light emitting heater consisting of a plurality of balls which contain carbon as a main ingredient, the light emitting heater being provided between the at least one pair of electrodes so as to produce an electric discharge when a voltage is applied across the at least one pair of electrodes, and an outlet port for discharging gases produced by the thermal decomposition of the wastes.

In the arrangement, electric discharges occur between the plurality of balls. Since the electric discharges occur at a high temperature of about 3000° C., almost all wastes, including PCBs, are thermally decomposed into harmless low molecular-weight substances without producing any harmful substances such as dioxin.

Thus, even wastes containing incombustible materials which cannot be disposed of in the general burning method can be thermally decomposed simultaneously without being separated or segregated, even when the wastes may contain materials which produce dioxin in the burning process, are thermally decomposed without being segregated. Thus, much time and cost are saved in the disposal of the wastes.

After the thermal decomposition, few remains are produced and no work for removing such remains is required.

The remainder of the burned wastes containing dioxin produced by burning the wastes, and wastes such as PCBs, whose processing methods have not been found and which have only been stored are thermally decomposed similarly into harmless low molecular-weight substances.

As described above, the present invention is realized by generating an extremely high temperature of about 3000° C. efficiently in a stabilized manner and by maintaining this temperature.

The electric discharging region is at a high temperature of about 3000° C. and a position distant ten-odd centimeters from the discharging region is at about 20° C. or less. Thus, the inner and outer walls of the thermal decomposition apparatus is capable of sufficiently maintaining a high temperature of about 3000° C. even with a simple structure. Thus, such an apparatus has a simple structure and is made inexpensively.

The low molecular-weight substances produced by the thermal decomposition are rapidly cooled from about 3000° C. to about 200° C. or less to eliminate the probability of dioxin being reproduced. If they are cooled gradually, the materials are at a temperature for a sufficient time where dioxin is likely to be produced.

The thermal decomposition apparatus preferably comprises a means for placing the heating chamber in an oxygen free environment such that the plurality of spheres are placed in an oxygen free environment. Thus, the plurality of spheres are prevented from oxidation, deterioration and deformation which would result in a decrease in discharge efficiency and usable life time. For example, when the plurality of balls each takes the form of a perfect sphere, they provide a very high discharging efficiency, whereas when they are deformed due to their oxidization and deterioration, the discharging efficiency decreases. The oxygen free environment in the present invention implies that the oxygen concentration is lower than that in air.

It is preferable that the oxygen concentration be much lower than that in air. When the oxygen concentration exceeds that in air, the plurality of balls are liable to be oxidized and deteriorated.

The apparatus preferably comprises a decompressing means for decompressing the heating chamber such that the plurality of balls are placed in a vacuum environment. In this case, a high discharging efficiency and a high temperature are readily obtained. In addition, a high temperature is obtained with less power to thereby reduce the operating cost of the apparatus. Like the case where the plurality of balls are placed in the oxygen free environment, they are prevented from deterioration and have a long usable life. Since the density of molecules present in the vacuum is low, production of new chemical substances are difficult. The vacuum in the present invention implies that the pressure is less than the atmospheric pressure.

It is preferable to have a lower pressure, or higher vacuum. A medium vacuum ($10^{-2}$ Pa to less than 10 Pa) will suffice. It may be a low vacuum (10 Pa to less than the atmospheric pressure).

The plurality of balls may be made of at least one material selected from the group consisting of charcoal, graphite, a carbon composite material, and mixtures thereof. As an example of charcoal, Japanese Bincho charcoal can be selected. Carbon such as charcoal and graphite has many pores on its surface and in the inside in which a gas is adsorbed. Thus, there is the problem that at high temperature the adsorbed gas will be released. Thus, it is preferable to process carbon, such as charcoal and/or graphite, such that their pores are closed to prevent adsorption of a gas.

The plurality of balls are preferably impermeable. In that case, their substance absorption is low to thereby decrease the probability that they will adsorb or desorb harmful substances. Thus, this prevents deterioration by with oxidization or by chemical substances, and results in a long usable life.

It is preferable that the plurality of balls take the form of a sphere. In order to cause electric discharges efficiently between the plurality of balls, they are preferably in point contact, one with another. If they are in line or surface contact with each other, an undesirable flow of electric currents occurs thereby reducing the discharge efficiency. Thus, when each are in the form of a sphere, they are in point contact with others and the discharges are performed efficiently, a high temperature is easily obtained, and the operating cost of the apparatus is low.

The use of the plurality of balls for a long time deteriorates the spheres from the discharges and oxidization, thereby deforming them, especially when the electric discharges concentrate on a particular area of the balls, the particular area is liable to deterioration. If the plurality of balls each take the form of a sphere, they rotate due to the action of the electric discharges. Thus, the electric discharges are difficult to concentrate on the particular part and there is a high probability that the electric discharges will occur uniformly among all areas on them. Thus, even when they are deteriorated and/or deformed, they are kept in the form of a sphere, and the probability that the electric discharge efficiency will be reduced is advantageously low.

As long as the plurality of balls are placed in point contact, they may each take the form of a polyhedron such as a dodecahedron or icosahedron. The term "sphere" used in the present invention should include a true sphere as well as a polyhedron. The plurality of balls each preferably takes the form of a perfect sphere.

Pressing means for pressing the wastes against the plurality of balls may be provided within the heating chamber.

By this arrangement, the wastes are placed in efficient contact with the discharging portions of the plurality of balls. Thus, the wastes are heated efficiently at a temperature, for example, of about 3000° C., to thereby improve the thermal decomposition efficiency of the wastes.

The apparatus may further comprise a filter made of at least one of active carbon and charcoal for allowing the decomposed gases to pass through.

In this case, even when the decomposed gases contain hydrocarbons, heavy metals and/or undecomposed harmful substances, the filter will adsorb the harmful substances to prevent them from being discharged.

The apparatus may further comprise a vacuum meter for measuring the pressure within the heating chamber, and pressure adjusting means for adjusting the pressure within the heating chamber to a predetermined value.

In this arrangement, the inside of the heating chamber is automatically adjusted to an optimal pressure.

The apparatus may further comprise an intervening spacer which contains carbon as a primary ingredient, the intervening spacer being placed between the plurality of balls and an inner wall of the heating chamber. Since, in this arrangement, the inner wall of the heating chamber is not in contact with the plurality of balls at high temperatures, the former is prevented from deterioration with heat to thereby improve the durability of the inner wall.

The intervening spacer may be made of a carbon material such as impermeable graphite, and its shape is not limited and may take the form of a plate or rod.

At least portions of the inner wall of the heating chamber which are placed in contact with the plurality of balls may be made of a monolithic refractory which contains at least one material selected from the group consisting of boron nitride (BN), niobium (Nb), silicon carbide (SiC), boron carbide ($B_xC_y$), magnesium oxide (MgO), hafnium oxide (HfO), hafnium dioxide ($HfO_2$), and beryllium aluminum oxide ($Al_2BeO_4$, BeO $Al_2O_3$). In this arrangement, the monolithic refractory has high thermal resistance which withstands a high temperature of about 3000° C. Thus, the inner wall of the heating chamber maintains its integrity.

Especially, since boron nitride has a high melting point of 3000° C., the monolithic refractory containing this material is excellent in thermal resistance, and the inner wall of the heating chamber maintains its integrity and does not melt. The inner wall of the heating chamber has high electrical resistance at high temperature, and no electric current flows through points where the inner wall of the heating chamber is in contact with the plurality of balls.

Addition of niobium and/or silicon carbide to the monolithic refractory improves its strength at high temperatures. Boron carbide includes various compounds of two ingredients. Monolithic refractories containing such compound have a low density and a high strength. Monolithic refractories containing hafnium oxide exhibit excellent corrosion resistance. Monolithic refractories containing magnesium oxide exhibit excellent thermal and fire resistance.

At least a part of the at least one pair of electrodes may take the form of a rod or horn surrounded by the plurality of balls to thereby improve the discharge efficiency.

The apparatus may further comprise a pipe for introducing liquid wastes into the heating chamber.

The thermal decomposition apparatus may further comprise a decomposed gas harm eliminating device for thermally decomposing harmful materials remaining in the decomposed gases into harmless gases. The decomposed gas harm eliminating device may comprise: a decomposed gas heating chamber for heating the decomposed gases; a decomposed gas inlet port for introducing the decomposed gases into a decomposed gas heating chamber; at least one pair of second electrodes provided within the decomposed gas heating chamber; a second light emitting heater consisting of a plurality of second balls which contain carbon as a primary ingredient, the second light emitting heater being provided between the at least one pair of second electrodes so as to produce an electric discharge when a voltage is applied across the at least one pair of second electrodes; a harmless gas outlet port for discharging the harmless gases; and a filter comprising at least one of active carbon and charcoal for allowing the harmless gases to pass through.

In such arrangement, electric discharges occur between the plurality of second balls of the device. The discharging regions are at a high temperature of about 3000° C. Thus, even when the decomposed gases contain hydrocarbon compounds and/or harmful substances, the device thermally decomposes them completely to render them harmless. Thus, there is a very low probability that any harmful substances will be discharged from the apparatus.

The decomposed gas harm eliminating device may further comprises at least one of: a second vacuum meter for measuring the pressure within the decomposed gas heating chamber, and second pressure adjusting means for adjusting the pressure within the decomposed gas heating chamber to a predetermined value; a second intervening spacer which contain carbon as a primary ingredient, the spacer being placed between the plurality of second balls and an inner wall of the decomposed gas heating chamber; at least portions of the inner wall of the decomposed gas heating chamber which are placed in contact with the plurality of second balls, the inner walls being made of a monolithic refractory which contain material selected from the group consisting of boron nitride, niobium, silicon carbide, boron carbide, magnesium oxide, hafnium oxide, hafnium dioxide, beryllium aluminum oxide, and mixtures thereof; and a second pair of electrodes having at least a part thereof in the form of a rod or horn surrounded by the plurality of second balls.

BRIEF DESCRIPTION OF THE DRAWINGS

Other objects, features and advantages of the present invention will become apparent by reference to the following detailed description and drawings in which.

DETAILED DESCRIPTION OF THE PREFERRED EMBODIMENTS

Embodiments of the thermal decomposition furnace according to the present invention will be described in more detail with reference to the accompanying drawings. The terms indicating directions such as "up", "down", "front", "rear", "right" and "left" represent respective directions in each of the drawings for convenience of explanation.

It is to be noted that the present invention is not limited to the embodiments described below.

(First Embodiment)

Figure 1:
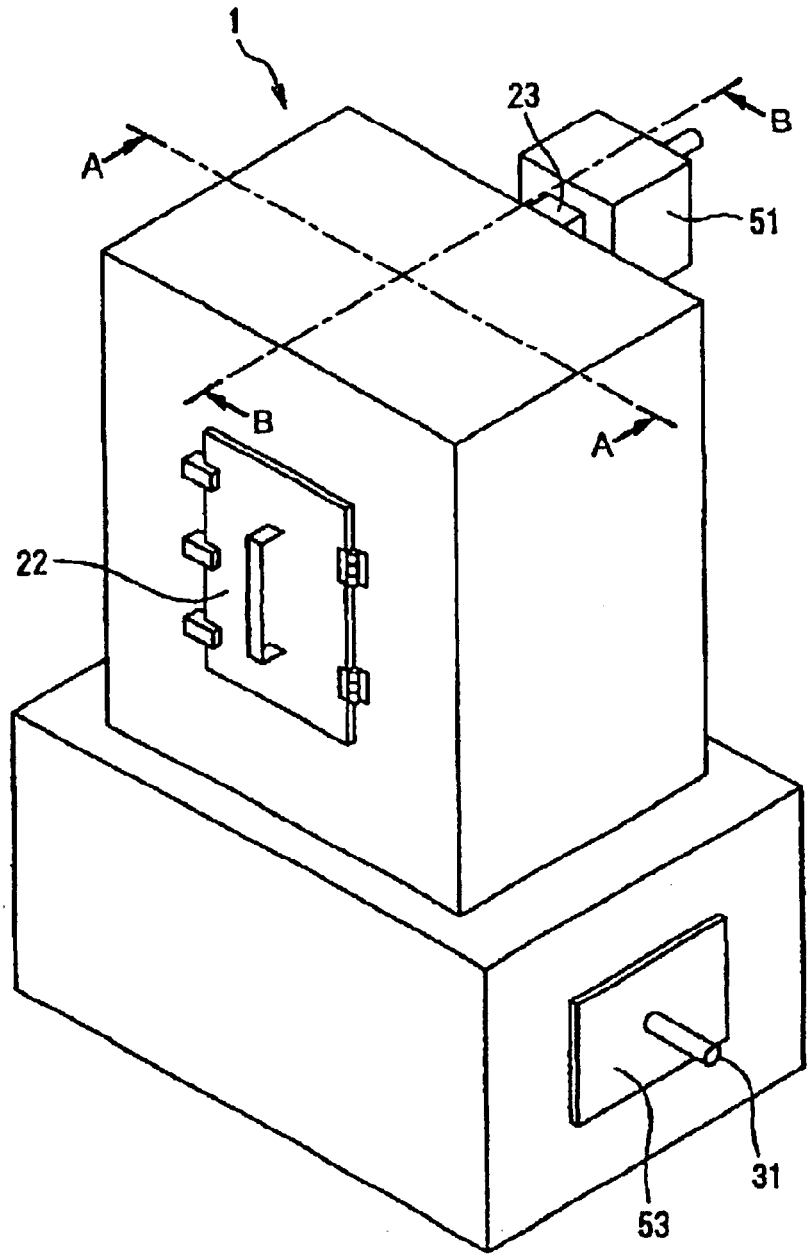
FIG. 1 is a perspective view of a thermal decomposition apparatus for wastes as a first embodiment.
Figure 2:
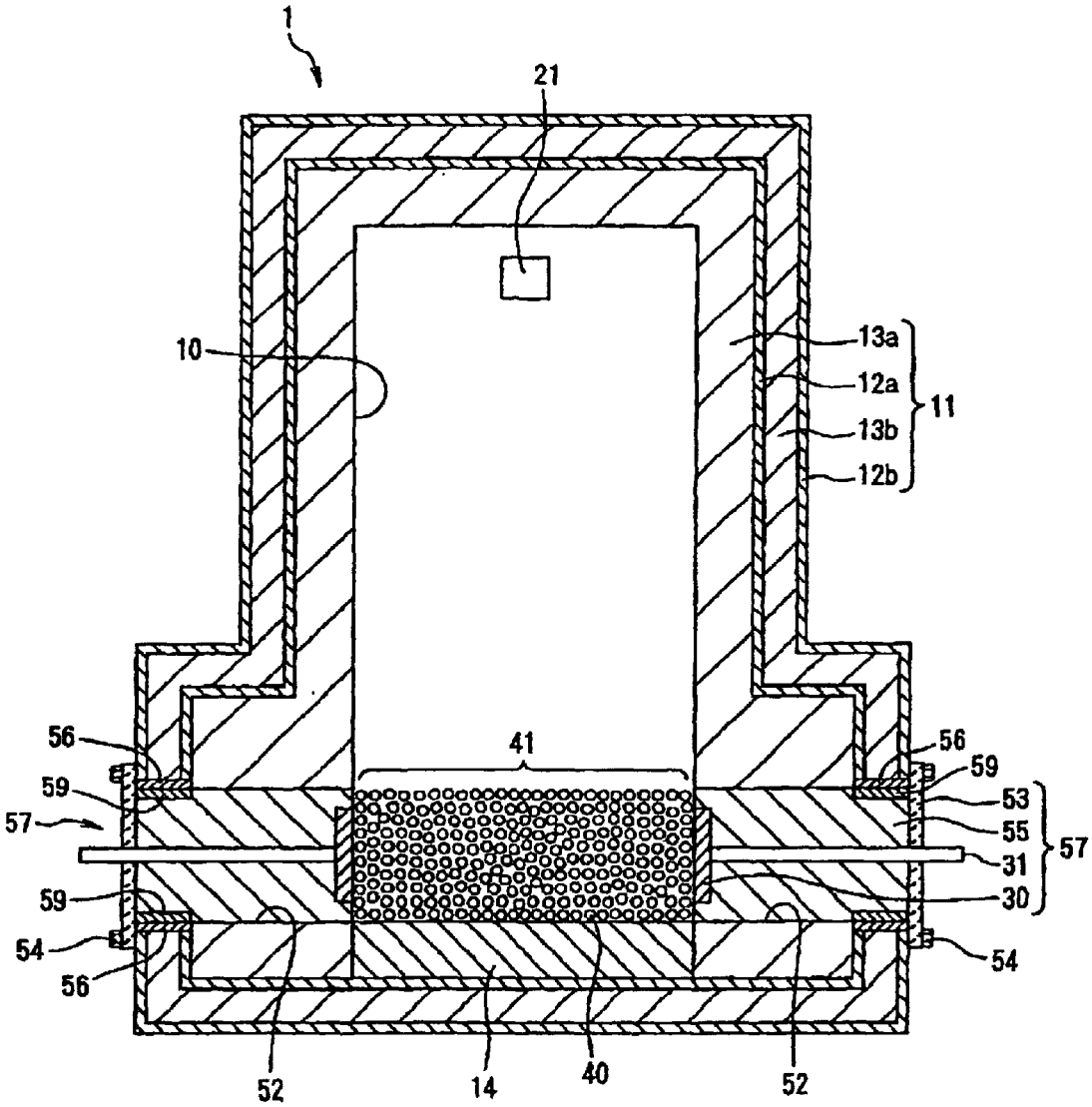
FIG. 2 is a cross-sectional view of the thermal decomposition apparatus taken along a line A—A of FIG. 1.
Figure 3:
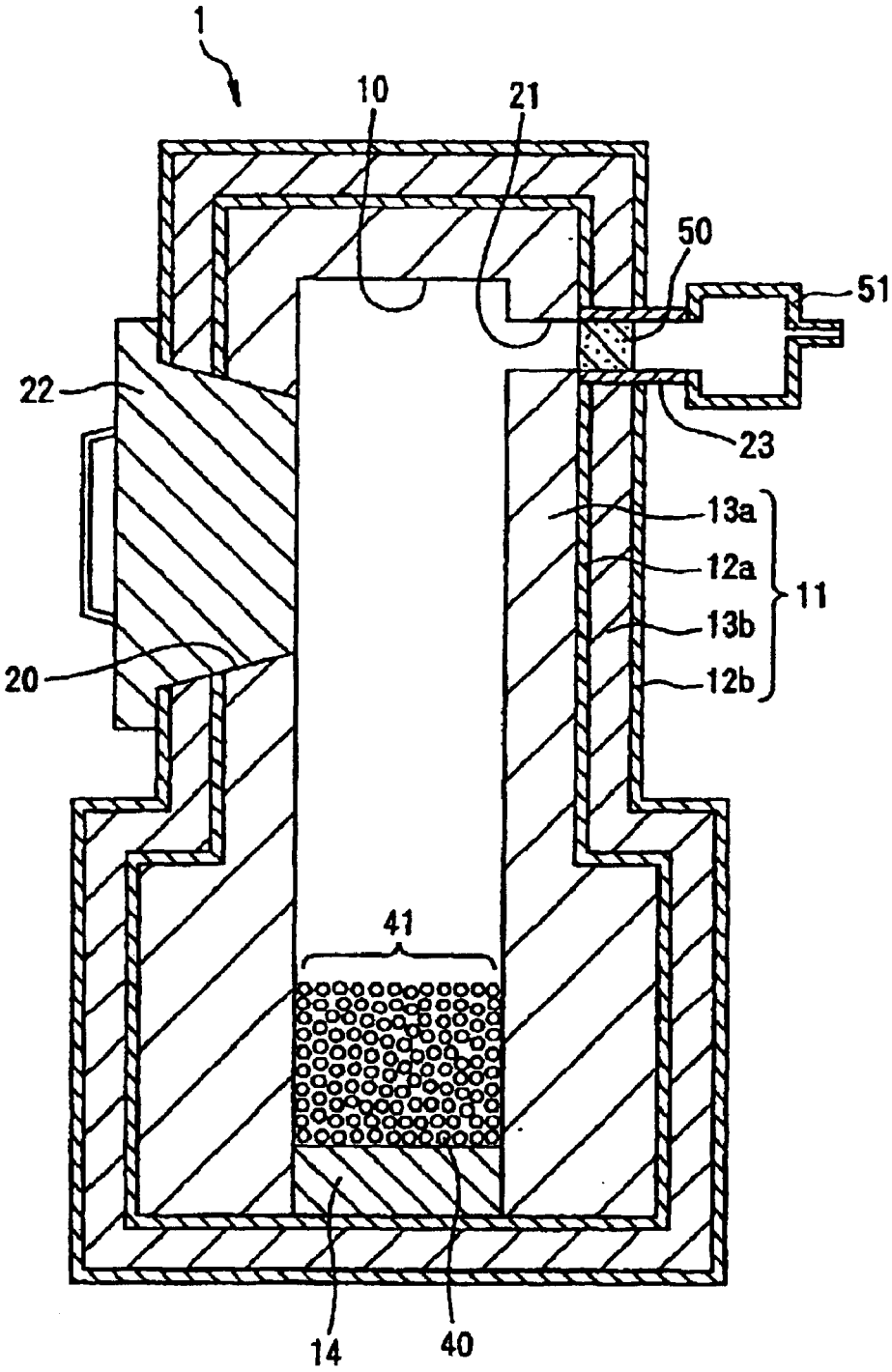
FIG. 3 is a cross-sectional view of the thermal decomposition apparatus taken along a line B—B of FIG. 1.

The apparatus 1 includes an internal heating chamber 10 with an inlet port 20 on its front (on the left side thereof in FIG. 3) through which the wastes are introduced into the heating chamber 10 and an outlet port 21 on its rear (on the right side thereof in FIG. 3) through which the resulting thermally decomposed wastes are discharged from the heating chamber 10. The inlet port 20 has an operable door 22 such that when closed provides an airtight seal of the heating chamber 10.

The thermal decomposition apparatus 1 has an outer wall 11 of a 4-layered structure composed of an innermost refractory concrete layer 13*a*, an inner iron plate 12*a*, an outer refractory concrete layer 13*b*, and an outermost iron plate 12*b* coated with a heat resistant coating. A portion of the innermost refractory concrete layer 13*a* positioned under a plurality of balls 40 in the form of spheres is replaced with a heat-resistant firebrick layer 14 whose joints are filled with a monolithic refractory, such as refractory concrete (not shown), to improve the airtightness of the heating chamber 10.

The inside of the heating chamber 10 is heated to a high temperature of about 3000° C. as will be described later. However, a temperature at a position distant from the plurality of balls 40 on the order of scores of centimeters is at a temperature of not higher than 200° C. and the inside of the heating chamber 110 is in an oxygen free or vacuum state. Thus, heat conduction is minimal and a simple structure will suffice for the outer wall 11.

The rectangular parallelepiped space surrounded by a refractory concrete layer 13*a* forms the airtight heating chamber 10 where the wastes introduced through the inlet port 20 are heated and thermally decomposed, and the resulting gases are discharged from the outlet port 21.

The heating chamber 10 is filled in its lower portion with a plurality of balls 40 comprised primarily of carbon such as graphite. A light emiting heater 41 consists of a plurality of balls 40. Since the plurality of balls 40 each take the form of a sphere, adjacent ones are in point contact with each other. The composition of the balls 40 and a method of making them will be described in detail later.

A pair of plate-like carbon electrodes 30 are each disposed on respective opposite sides of a lower portion of the heating chamber 10 such that the plurality of balls 40 are disposed between the pair of carbon electrodes 30 from which a corresponding pair of carbon rods 31 extend outwardly through the corresponding outer walls 11 of the apparatus 1. Each carbon rods 31 may be replaced with a heat-resistant refractory stainless steel one. It is to be noted that when the apparatus 1 has a structure in which the pair of stainless steel rods extend through carbon electrodes 30 and come into contact with the plurality of balls 40, the portions of the pair of stainless steel rods which come into contact with the plurality of balls 40 should be covered by a carbon material to prevent deterioration thereof.

The outlet port 21 is in fluid communication with a vacuum pump 51 through an exhaust pipe 23. The vacuum pump 51 corresponds to a means for producing an oxygen free environment or decompressing means as an element of the present invention. A vacuum meter and pressure adjusting means (not shown) are provided within the exhaust pipe 23. The pressure within the heating chamber 10 is measured by the vacuum meter. When the pressure measured by the vacuum meter exceeds a predetermined value, excess gas is automatically adjusted (discharged) by the pressure adjusting means to maintain the pressure within the heating chamber 10 at a constant value. In order that the heating chamber 10 is placed in the oxygen free or vacuum environment, any means may be used as the oxygen free environment producing means or decompressing means.

A fiber-like active carbon filter 50 is provided within the exhaust pipe 23. The active carbon filter is a porous matrix comprising micropores with diameters less than 2 nm, medium pores with diameters from 2 nm to 100 nm, and macropores having diameters greater than 100 nm, and has a specific surface area of 500–1700 $m^2/g$. Thus, the active carbon has a strong adsorptivity which can physically adsorb relatively large molecules wherein the pores of various sizes adsorb various molecules. Especially, the active carbon is excellent in adsorbing hydrocarbons such as methane. Instead of the fiber-like active carbon filter 50, particulate active carbon may be used as the filter. A filter of a material other than carbon may be used as long as it has excellent adsorptivity.

A pair of openings 52 each are provided axially outside a respective pair of carbon electrodes 30 through the corresponding sides of the apparatus 1 for inspection/maintenance of the inside of the apparatus 1 (including inspection of any deterioration in the quality of the balls 40 and carbon electrodes 30 and replacement thereof).

Each opening 52 is covered with an ceramic plate 53, which is removably fixed by bolts 54 to the outer wall 11. A refractory sealing sheet (not shown) is provided between each cover 53 and a corresponding surface of the iron plate 12*b* of the outer wall 11 to provide satisfactory airtightness for the apparatus 1. A refractory concrete block 55 is filled between each carbon electrode 30 and a corresponding cover 53 to provide satisfactory maintenance of the temperature within the apparatus 1. The cover 53 may be an iron plate covered with an insulating material. The refractory concrete block 55 may be replaced with a firebrick.

The four members, i.e., the cover 53, refractory concrete block 55, carbon electrode 30 and carbon rod 31, form an united electrode unit 57. Thus, the cover 53, refractory concrete block 55, carbon electrode 30 and carbon rod 31 are not required to be removed individually to replace the carbon electrode 30 with a new one. Instead, the electrode unit 57 is replaced wholly to facilitate replacing the carbon electrode 30 with a corresponding new electrode.

An outer rectangular iron frame 56 is provided so as to fit fixedly into an inner edge of each opening 52. A corresponding inner rectangular iron frame 59 is received within the corresponding rectangular iron cylindrical frame 56 so as to fit fixedly over a corresponding end portion of the refractory concrete block 13 for covering purposes such that the iron frame 59 slides along with the electrode unit 57 relative to the frame 56 to move the electrode unit 57 into/out of the opening 52.

A method of thermally decomposing the wastes, using such decomposing apparatus 1, will be described in detail next.

First, the door 22 of the inlet port 20 for the decomposition apparatus is opened, the wastes (not shown) are cast into the apparatus so as to be placed on the plurality of balls 40.

The vacuum pump 51 is then actuated to evacuate the heating chamber 10 into a vacuum state (for example, a high vacuum of about $6.7\times10^{-2}$ Pa or a lower vacuum of about 0.02–0.06 MPa). Thus, the plurality of balls 40 in the heating chamber 10 are also placed in the vacuum state.

The pair of carbon rods 31 are connected to a power supply (not shown). When the pair of carbon electrodes 30 are impressed with a voltage of about 200 V (a current of 300–400 A), electric discharges occur among the balls 40 within the chamber 10. Electric discharges occur in the whole of the light emitting heater 41. In order to increase the discharge power, the pair of carbon electrodes 30 are required to be supplied with a voltage of 400–500 V (a current of 100–150 A)

Figure 4:
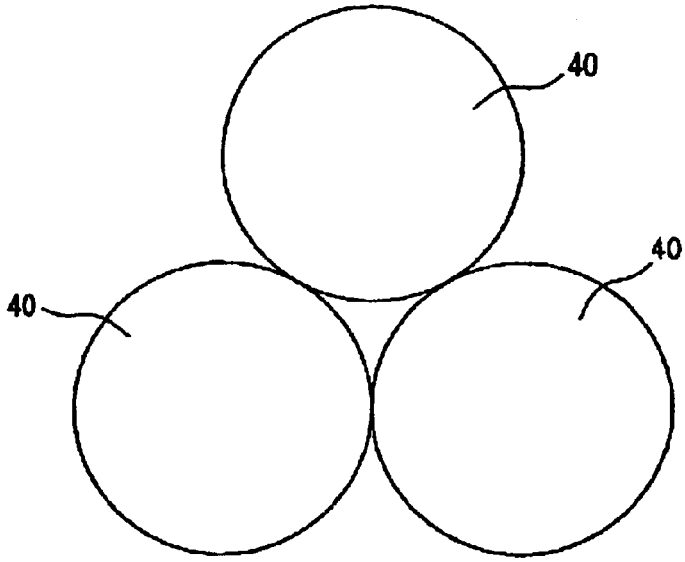
FIG. 4*a* schematically illustrates the balls in contact with each other.
FIG. 4*b* schematically illustrates electric discharges occurring among the plurality of balls.
Figure 4:
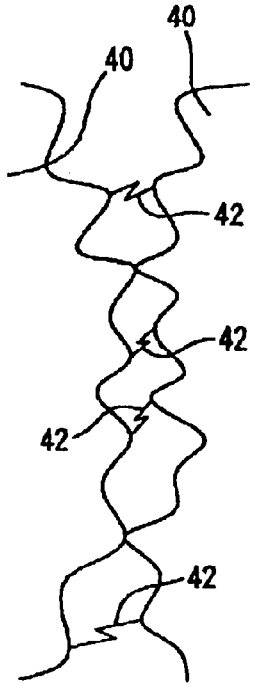

The mechanism of occurrence of the electric discharges will be described with reference to FIGS. 4(*a*) and (*b*). FIG. 4(*a*) shows three balls 40 placed in contact with each other. FIG. 4(*b*) illustrates the contacting portions of any two of the balls 40 in an enlarged view.

Since the plurality of balls 40 are in the shape of a sphere, adjacent ones are in point contact with each other. Each ball 40 has a microscopically rugged surface. Thus, any adjacent balls 40 have microscopical convexities in contact with each other and concavities between the convexities on this surfaces. When a voltage is applied across the pair of electrodes, electric currents flow through points at which any two balls 40 are in contact with each other. However, the areas of the contact points are small and large currents cannot flow through the contact points, and electric discharges 42 occur across the concavities on the surfaces of the adjacent balls. When the balls 40 are in line/surface contact with each other providing large contact areas, large currents would flow through the areas and the discharge efficiency is reduced.

The discharge region (at spark 42) is at a temperature of about 3000° C. and the environment of the plurality of balls 40 is stabilized at a high temperature of 3000° C. in a relatively short time on the order of scores of seconds after a voltage is applied across the pair of carbon electrodes. At this time, the outer wall 11 (iron plate 12*b*) of the decomposition apparatus 1 is at about room temperature. If the electric discharges occur in a stabilized state, the voltage can be reduced to about 30 V (a current of 300–400 A). The resulting temperature may be adjustable depending on the applied voltage, as desired.

The use of the plurality of balls 40 for a long time causes deterioration. This is due to the electrical discharge resulting in oxidation and subsequent deformation. This is especially true when the discharges are concentrated in a limited area of a sphere. Since the plurality of balls 40 each take the form of a sphere, they rotate due to the action of the electric discharges. Thus, the electric discharges are difficult to concentrate on the particular parts of the balls 40 and there is a high probability that the electric discharges will occur uniformly over the entire sphere. Thus, even when they are deteriorated and/or deformed, they maintain the shape of a sphere, and the probability that the electric discharge efficiency will be reduced is advantageously low.

The wastes placed on the plurality of balls 40 are not burned but are heated to a high temperature of about 3000° C. and thermally decomposed into harmless gases of low molecular weight substances without producing harmful substances such as soot, dust, chlorine compounds such as hydrogen chloride, nitrogen compounds such as $NO_x$, and harmful substances such as dioxin. If such harmful substances are contained in the wastes, they are similarly thermally decomposed at the high temperature into gases of harmless low molecular weight substances.

Almost all wastes including powder/solid PCBs, except for metals having high boiling points, are thermally decomposed at the high temperature of about 3000° C., in which case, few solids remain. Thus, incombustible wastes including glass articles such as bottles and metal articles such as cans, industrial wastes, medical wastes and shredder dust are thermally decomposed simultaneously without being segregated, not to mention general wastes such as kitchen garbage and resins. When glass articles such as bottles are broken into pieces of substantially the same size as the balls 40, they come easily into contact with the balls 40 to thereby improve the thermal decomposition speed. Formless wastes are temporarily hardened to a lump having a fixed shape, for example, by compression and then broken into pieces to thereby improve the thermal decomposition speed similarly.

The electric discharges produce heat and light. The light is considered to be effective in enhancing the thermal decomposition of the harmful substances. Especially, when dioxin is thermally enhancement is considered to be large.

The decomposed gases can contain harmless low molecular weight substances as well as hydrocarbons and heavy metals, and are adsorbed by the active carbon filter 50. Thus, they are not discharged from the outlet port 21 of the apparatus 1. Any small amount of harmful substances remaining are adsorbed by the filter 50. Thus, no harmful gas is discharged from the outlet port 21 of the apparatus 1.

The filter 50 can be regenerated by spraying with water vapor of 120–200° C. Thus, this filter is excellent both in economy and prevention of secondary pollution. When the filter 50 reaches a designated loading of heavy metals, the filter 50 is replaced. The heavy metals may be recovered by methods such as grinding and sifting according to the specific gravity.

As long as the object of the present invention is achieved, the positions of the inlet port 20, outlet port 21, vacuum pump 51 and the pressure adjusting device relative to the apparatus 1 are not limited to those of the present embodiment. For example, while the vacuum pump 51 is illustrated as being disposed outside the apparatus 1 in the present embodiment, it may be disposed within the apparatus 1.

While in the present embodiment the wastes are illustrated as being thermally decomposed in a state where they are placed on the plurality of balls 40, it is preferable that the wastes are pressed against the plurality of balls 40, for example, by a spring or a weight placed on the wastes, and the percentage of the wastes coming into contact with the plurality of balls 40 increases to thereby increase the rate of thermal decomposition of the wastes.

Figure 5:
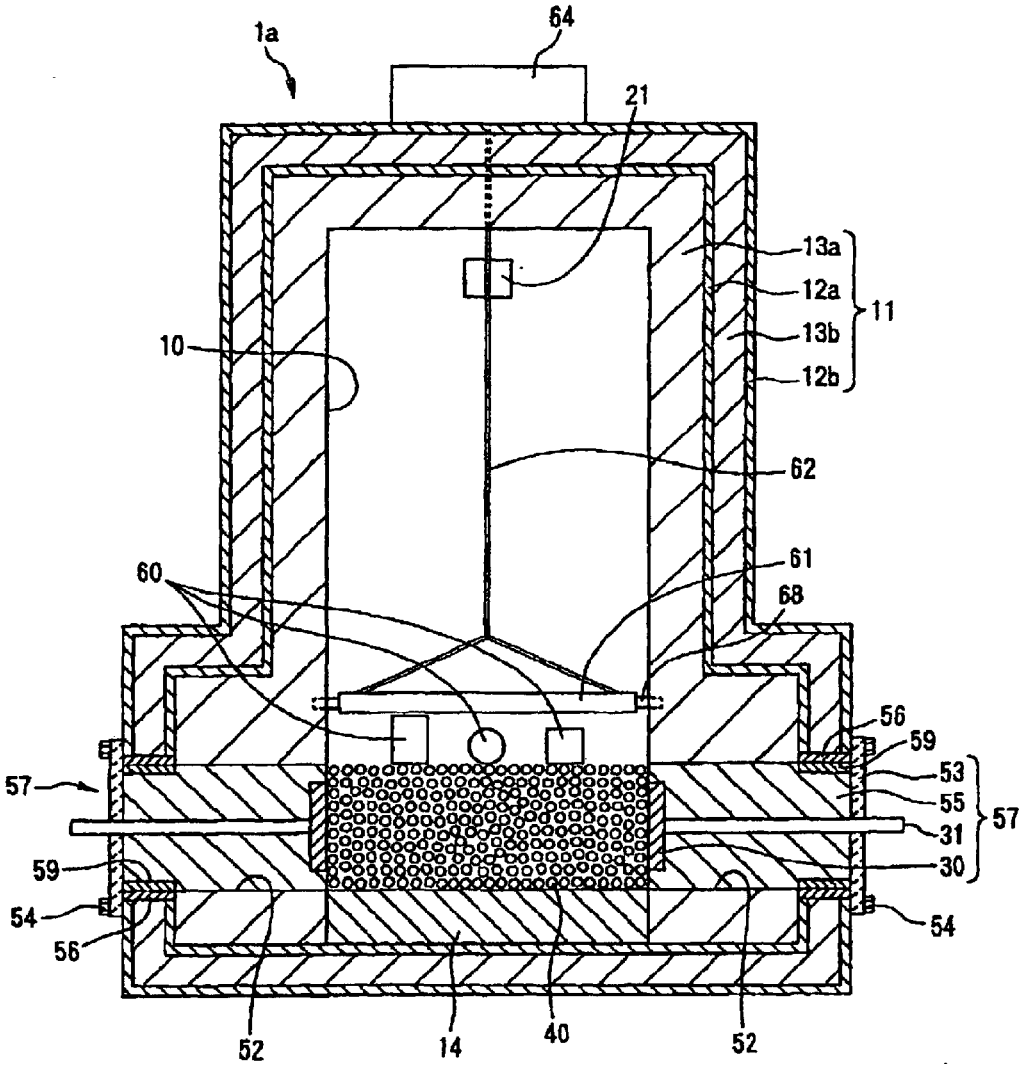
FIG. 5 is a vertical cross-sectional view of a modification of the first embodiment.
Figure 6:
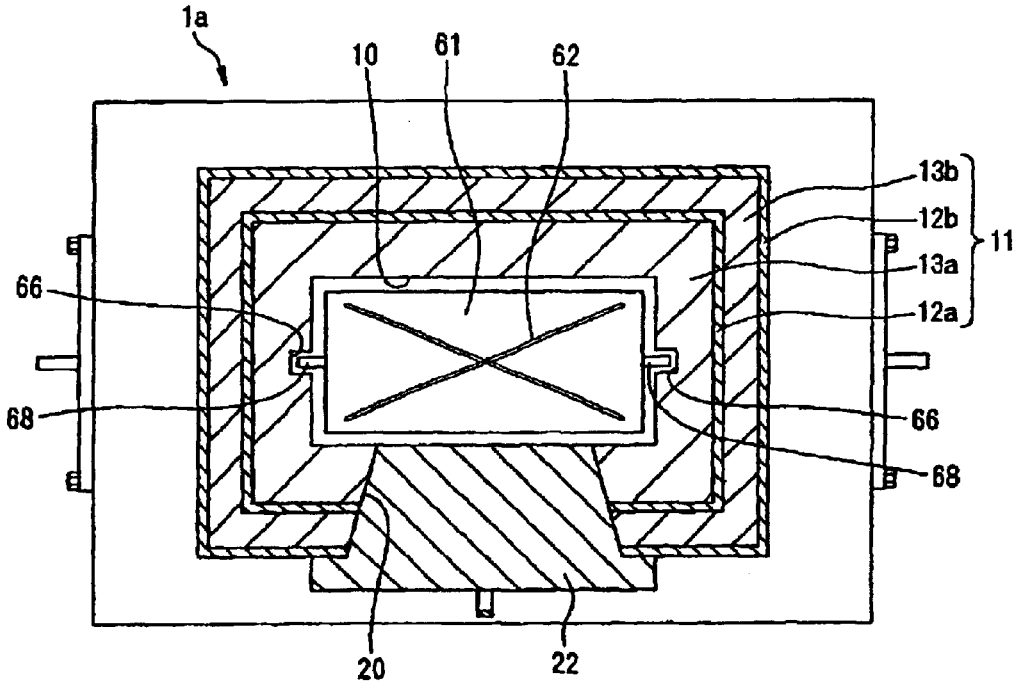
FIG. 6 is a horizontal cross-sectional view of a modification of the first embodiment.

FIGS. 5 and 6 show a modification of the first embodiment which comprises a pressing means for pressing the wastes against the plurality of balls 40. FIG. 5 is a vertical cross-sectional view of the thermal decomposition apparatus 1*a* of the modification. FIG. 6 is a horizontal cross-sectional view of the thermal decomposition apparatus 1*a*. In FIGS. 5 and 6, the same reference numeral as that used in FIGS. 1–4 is used to denote the same element as, or an element corresponding to, that of the thermal decomposition apparatus 1 of the first embodiment.

Further description of elements of the thermal decomposition apparatus 1*a* of the modification, identical or corresponding to ones of the thermal decomposition apparatus 1 of the first embodiment will be omitted and only elements of the modification different from those of the thermal decomposition apparatus 1 of the first embodiment will be explained next.

A pressure plate 61 presses the wastes 60 against the plurality of balls 40 due to its own weight and is suspended in a horizontal state by a rope 62 within the heating chamber 10. The rope 62 separates halfway into four subrope portions fixed to the respective corners of the pressure plate 61 such that the pressure plate 61 can be easily maintained in a horizontal attitude.

The rope 62 is connected at an upper end to an elevator 64 attached to the top of the thermal decomposition apparatus 1*a* such that the elevator 64 feeds out or rewinds the rope 62 to elevate and lower the pressure plate 61 within the heating chamber 10.

The heating chamber 10 has a pair of grooves 66 each provided on a respective one of opposite inner walls thereof and receiving slidably a respective horizontal projection 68 each provided at opposite sides of the pressure plate 61 such that the pressure plate 61 move up and down along the pair of grooves 66 in the opposite inner walls in a stabilized manner.

The pressing means which comprises a pressure plate 61, rope 62 and elevator 64. The pressure plate 61 is lowered depending on a degree of decomposition of the wastes 60 (a decomposed size of the wastes 60). Thus, the wastes 60 can be pressed against the plurality of balls 40 to maintain an efficient contact state at all times to thereby improve the decomposition speed of the wastes 60. The decomposition speed can be improved by about 30–40% depending on the weight of the pressure plate 61, the kind of wastes 60 and the degree of vacuum.

Although the rope 62 is connected to the elevator 64 through the outer wall 11 of the decomposition apparatus 1*a*, the airtightness of the heating chamber 10 is sufficiently maintained.

The material of the pressure plate 61 is not limited as long as it has a sufficient weight, heat resistance and corrosion resistance. The material of the rope 62 is not limited as long as it has sufficient strength, heat resistance and corrosion resistance. The materials of the pressure plate 61 and rope 62 preferably include carbon, impermeable graphite, ceramic or heat-resisting stainless steel. The elevator 64 may be of the electrically or manually actuated type.

As an alternative, the means for pressing the pressure plate 61 against the wastes 60 may include a spring.

(Second Embodiment)

Figure 7:
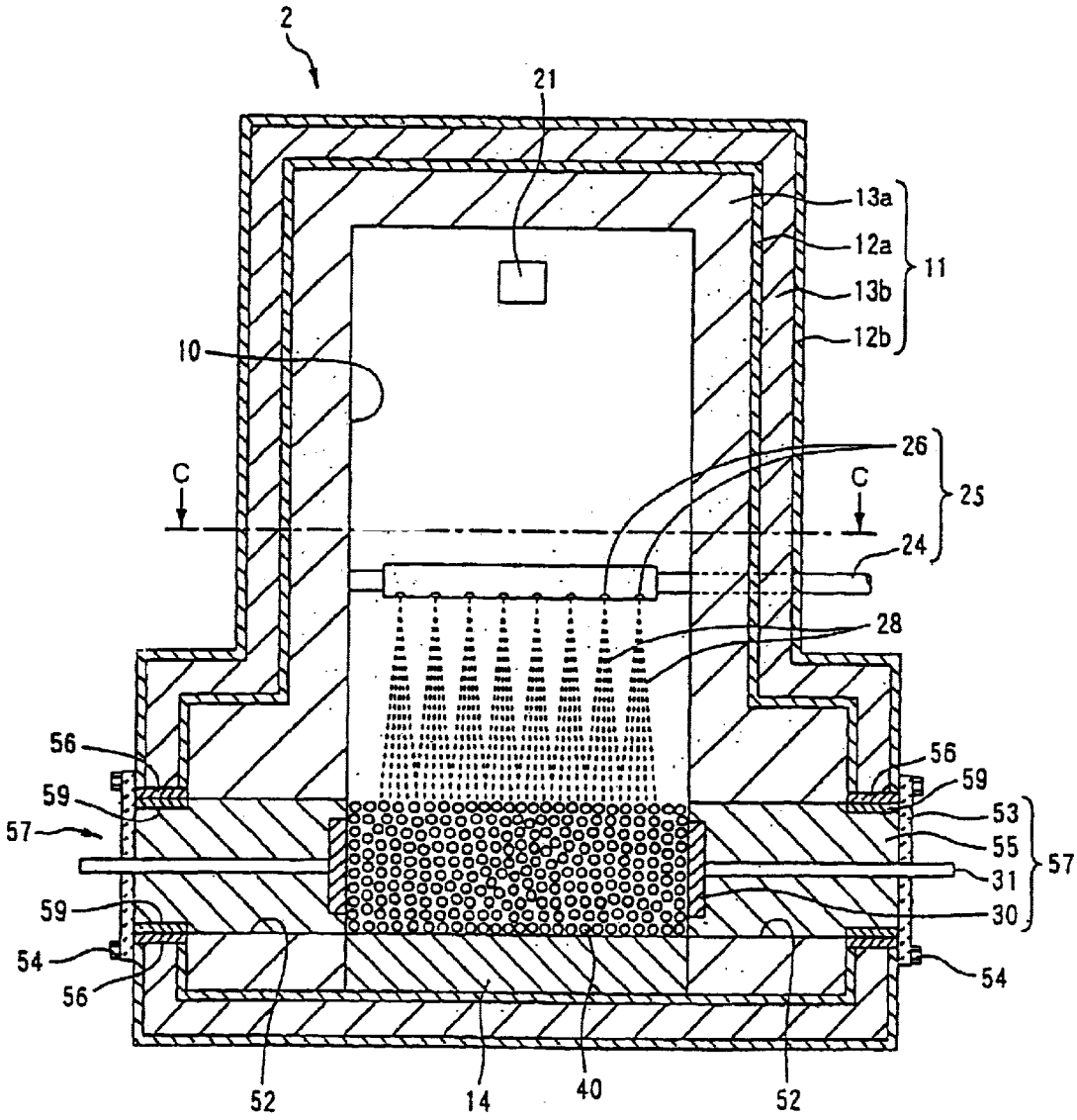
FIG. 7 is a cross-sectional view of a thermal decomposition apparatus for wastes as a second embodiment.
Figure 8:
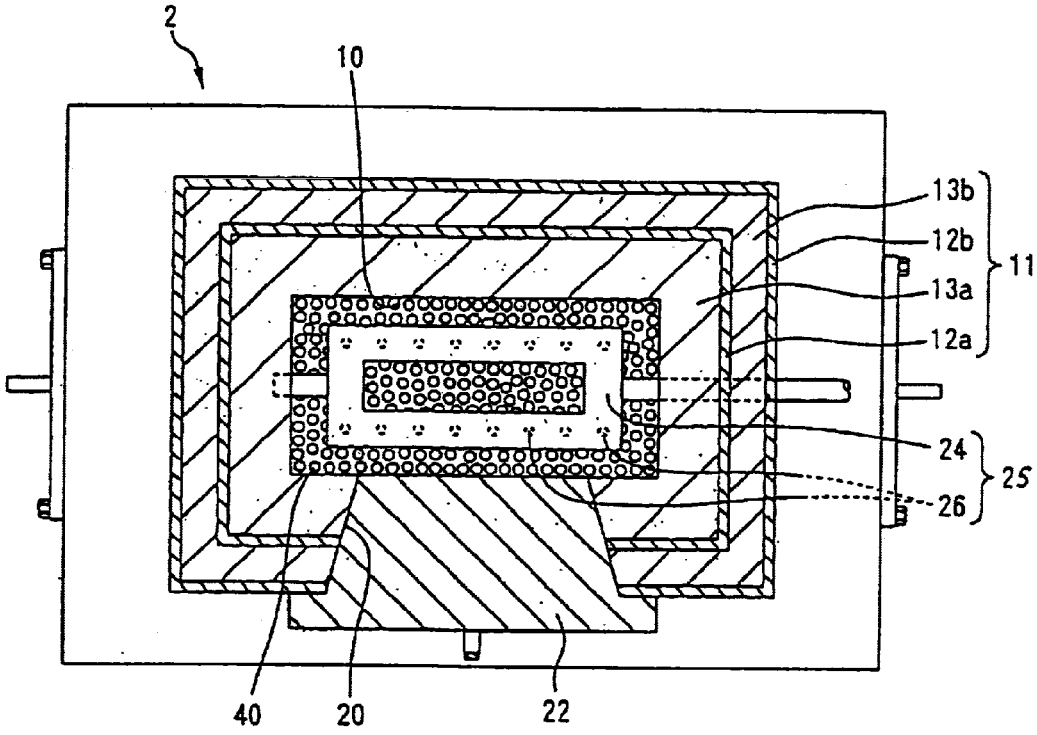
FIG. 8 is a cross-sectional view of the thermal decomposition apparatus taken along a line C—C of FIG. 7.

FIG. 7 is a vertical cross-sectional view of a thermal decomposition apparatus 2 for wastes in the second embodiment. FIG. 8 is a horizontal cross-sectional view taken along a line C—C in FIG. 7. The same reference numeral is used to denote the identical or similar elements of the second and first embodiments in FIGS. 7, 8 and 1–4.

The thermal decomposition apparatus 2 of the second embodiment has an inlet port 25 suitable for introducing liquid wastes such as waste oils, waste liquids and/or PCBs into the heating chamber, and is suitable for disposition of such liquid-like wastes. Further description of elements of the thermal decomposition apparatus 2 of the second embodiment identical or similar to those of the thermal decomposition apparatus 1 of the first embodiment will be omitted and only elements of the second embodiment different from those of the first embodiment will be explained next.

An inlet pipe 24 extends into the heating chamber 10 through a side wall of the decomposition apparatus 2 for feeding the liquid wastes into the heating chamber. The inlet pipe 24 separates into a plurality of subpipes (two in FIG. 8) and then merges into a single second pipe which is terminated and fixed in the inner wall of the heating chamber 10 opposite to the side wall of the heating chamber 10 through which the inlet pipe 24 passes.

The subpipes placed within the heating chamber 10 each have a plurality of holes 26 arranged through its length on its lower surface such that the liquid wastes 28 flowing through the inlet pipe 24 are discharged in the form of a shower from the plurality of holes 26 against the plurality of balls 40. The inlet port 25 suitable for introducing liquid wastes is composed of the inlet pipe 24 and its holes 26.

The shape of portions of the inlet tube 24 within the heating chamber 10 is not especially limited, but is freely designable. While in the present embodiment the inlet pipe 24 is illustrated as being separated into the subpipes which then merge into one, it may be a non-divergent pipe or a divergent and non-merging pipe.

The material of the inlet pipe 24 is not especially limited as long as it has heat resistance and corrosion resistance to liquid wastes. Preferably, the material of the inlet pipe 24 include, for example, carbon, impermeable graphite, ceramic or heat resistant stainless steel.

A method of thermally decomposing the liquid wastes using the thermal decomposition apparatus 2 is similar to that used in the case of the first embodiment and further description thereof will be omitted.

(Third Embodiment)

Figure 9:
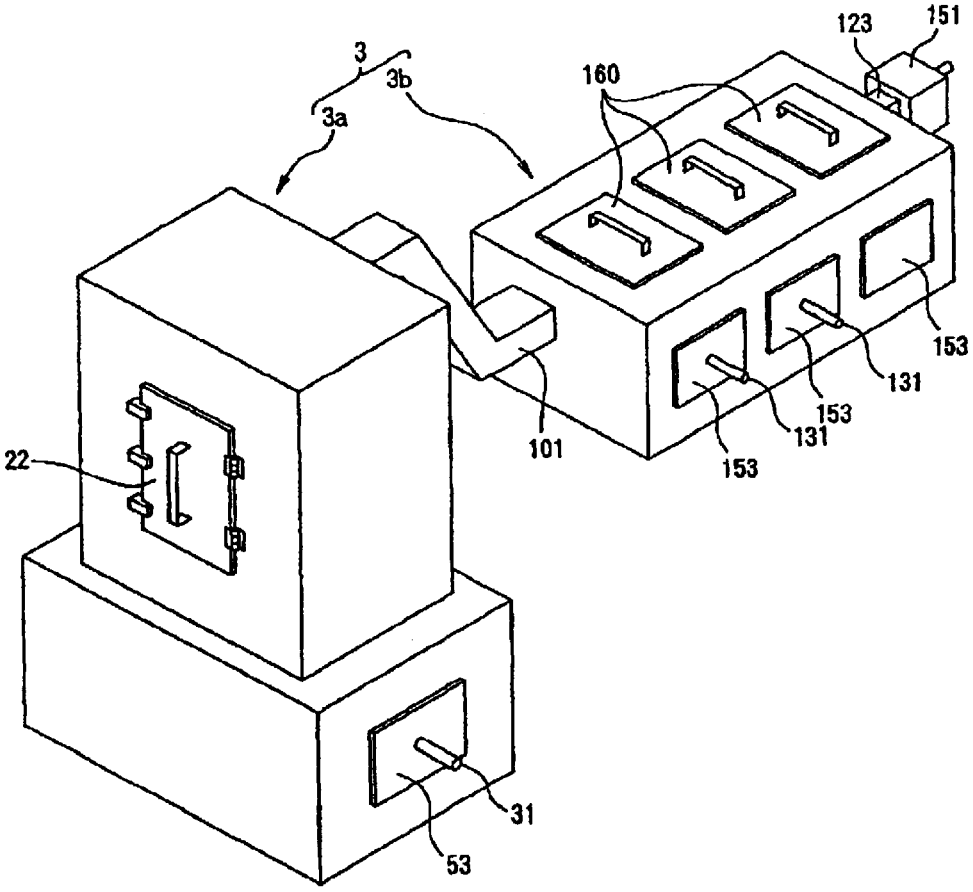
FIG. 9 is a perspective view of a thermal decomposition apparatus for wastes as a third embodiment.
Figure 10:
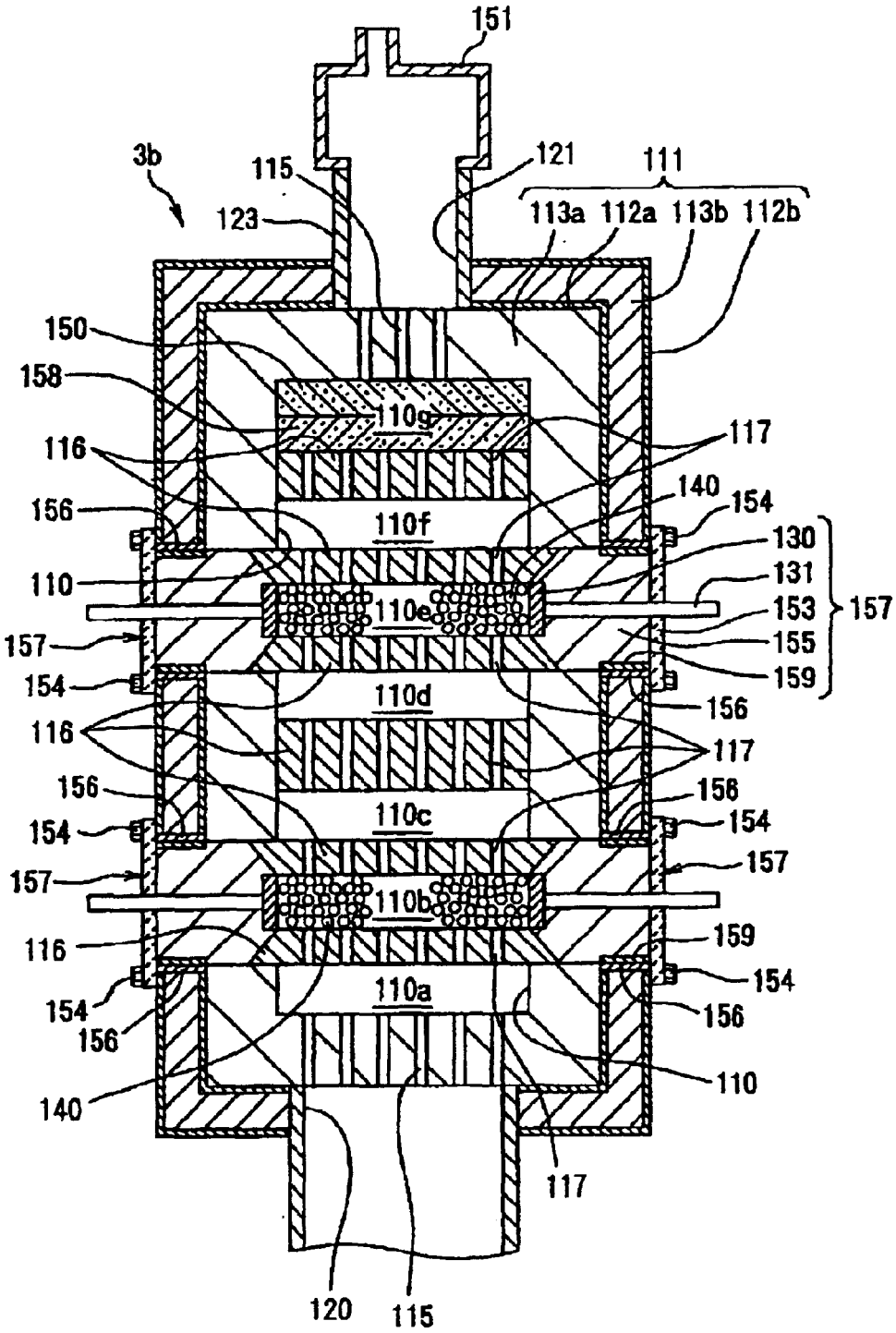
FIG. 10 is a partial horizontal cross-sectional view of the thermal decomposition apparatus of FIG. 9.

FIG. 9 is a perspective view of a thermal decomposition apparatus 3 for wastes as a third embodiment. FIG. 10 is a horizontal cross-sectional view of a decomposed gas harm eliminating device 3*b* of the thermal decomposition apparatus 3.

The thermal decomposition apparatus 3 as the third embodiment comprises a thermally decomposing device 3*a* and a decomposed gas harm eliminating device 3*b* connected to the thermal decomposing device 3*a*. The thermal decomposing device 3*a* thermally decomposes the wastes. The decomposed gas harm eliminating device 3*b* heats to a high temperature gases produced by thermal decomposition of the wastes in the thermal decomposing device 3*a* to thermally decompose harmful substances remaining in the decomposed gases, thereby rendering the decomposed gases harmless.

The thermally decomposing device 3*a* is identical to the thermal decomposition apparatus 1 of the first embodiment except that the former lacks a filter such as that shown by 50 and a vacuum pump such as that shown by 51 and therefore the composition of the decomposed gas harm eliminating device 3*b* alone will be described below. In the present embodiment, the same element as, or an element corresponding to, that of the thermal decomposition apparatus 1 of the first embodiment is identified by the same reference numeral as was used in the first embodiment. In an alternative, the thermally decomposing device 3*a* may be replaced with the thermal decomposition apparatus 2 of the second embodiment.

The decomposed gas harm eliminating device 3*b* includes a decomposed gas heating chamber, 110 has a decomposed gas inlet port 120 on its front for introducing the decomposed gases into the heating chamber 110, and a harmless gas outlet port 121 on its rear for discharging the harmless decomposed gases out of the heating chamber 110. The outlet port 21 of the thermally decomposing device 3*a* is in fluid communication through a connecting pipe 101 with the inlet port 120 of the decomposed gas harm eliminating device 3*b*. A vacuum pump 151 is in fluid communication with the outlet port 121 through a discharge pipe 123.

The decomposed gas harm eliminating device 3*b* has an outer wall 111 with a 4-layered structure similar to that of thermally decomposing device 3*a*. The outer wall 111 includes an innermost refractory concrete layer 113*a*, an inner iron plate 112*a*, an outer refractory concrete layer 113*b* and an outermost iron plate 112*b* coated with a heat resistant coating. A portion of the innermost refractory concrete layer 113*a* positioned under a plurality of second balls (to be described later) 140 is replaced with a heat-resisting refractory firebrick layer (not shown) whose joints are filled with a monolithic refractory such as refractory concrete (not shown) to improve the airtightness of the decomposed gas heating chamber 110.

The heating chamber 110 is heated to a high temperature of about 3000° C. A temperature at a position on the order of scores of centimeters distant from the plurality of second balls 140 is not higher than 200° C. and that the heating chamber 110 is in an oxygen free or vacuum state, so that heat conduction is minimal, and therefore, a simple structure will suffice for the outer wall 111.

The heating chamber 110 for the decomposed gases comprises an airtight rectangular parallelepiped space surrounded by the innermost refractory concrete layer 113*a*. The innermost refractory concrete layer 113*a* has two groups of holes 115 each corresponding to one of the inlet and outlet ports 120 and 121 for allowing the decomposed and harmless gases to flow through into and out of the heating chamber 10 respectively.

In such an arrangement, the decomposed gases introduced from the inlet port 120 are heated and decomposed within the heating chamber 110 to become harmless gases, which are then discharged from the outlet port 121.

The decomposed gas heating chamber 110 is separated by a plurality of (6 in FIG. 10) spaced partitions 116 of a refractory firebrick into a plurality of (7 in FIG. 10) subchambers 110*a*–110*g* arranged longitudinally within the device 3*b*. The foremost subchamber 110*a* is in fluid communicates with the inlet port 120 whereas the rearmost subchamber 110*g* is in fluid communication with the outlet port 121.

Each partition 116 has a plurality of holes 117 provided at equal intervals through its length so as to cause adjacent subchambers to be in fluid communication. In such arrangement, the decomposed gas heating chamber 110 has therein a plurality of substantially straight gas fluid paths extending through the foremost subchamber 110*a*, holes 117, subchamber 110*b*, holes 117, subchamber 110*c*, holes 117, subchamber 110*d*, holes 117, subchamber 110*e*, holes 117, subchamber 110*f*, holes 117 and the rearmost subchamber 110*g* such that the decomposed gases enters the inlet port 120 flows through them and discharges from the outlet port 121 to the outside.

A pair of second electrodes consisting of two plate-like carbon electrodes 130 may be each disposed on the right and left sides of any of the subchambers (the second and fifth subchambers 110*b* and 110*e* from the front in FIG. 10) except for the rearmost subchamber 110*g*. Each carbon electrode 130 has a carbon rod 131 which extends outward through the outer wall 111 of the decomposed gas harm eliminating device 3*b*.

The rearmost subchamber 110*g* is filled with a fiber-like active carbon filter 150 and Bincho charcoal 158 to adsorb hydrocarbon and metals. Each subchamber for which a corresponding pair of carbon electrodes 130 are disposed is filled with a plurality of second balls 140 which have the same composition as the plurality of balls 40 of the first embodiment. A second light emitting heater consists of the plurality of second balls. In an alternative, the filter 150 may be replaced with a particulate active carbon filter. A filter of a material other than carbon may be used if it has sufficient absorptivity.

The sizes and shapes of the holes 115 and 117 are not limited, except to prevent the passage of the second balls 140. If the second balls 140 each take the form of a sphere, the shape of the holes 115 and 117 preferably have a cross-section of a triangle. The holes 115 and 117 may take the form of a horizontal or vertical slit. For example, instead of using partitions 116 with holes 117, a plurality of ceramic pillars may be arranged in parallel to form a plurality of spaced slits which serve to increase the areas of openings of the holes 117. Thus, use of the plurality of slits is preferable when a large amount of decomposed gas is processed.

An opening 152 is provided for each of a pair of carbon electrodes 130 in the decomposed gas harm eliminating device 3*b* for inspection and maintenance of the inside of the device 3*b* (inspection of a degree of deterioration and replacement of the plurality of second balls 140 and the carbon electrode 130 concerned).

Each ceramic cover 153 is fixed with bolts 154 to the outer wall 111 through a refractory sheet (or seal) (not shown) covering a corresponding opening 152, thereby maintaining the inner airtightness of the decomposed gas harm eliminating device 3*b*. Since each refractory concrete block 155 is fitted between the corresponding carbon electrode 130 and ceramic cover 153, the temperature within the decomposed gas harm eliminating device 3*b* is sufficiently maintained. In an alternative, the ceramic cover 153 may be replaced with an iron cover coated with an insulating material. The refractory concrete block 155 may be replaced with a refractory firebrick block.

Each ceramic cover 153, a corresponding refractory concrete block 155, a corresponding carbon electrode 130, and a corresponding carbon rod 131 compose a united electrode unit 157. Thus, replacement of an old or defective electrode unit 157 is simplified.

A rectangular iron frame 156 is provided so as to cover the inner periphery of an outer axial end portion of the corresponding opening 152 provided in the outermost refractory concrete layer 113*b*. A rectangular iron frame 159 is wound around an outer axial end portion of the refractory concrete block 155 and also fits in the rectangular iron frame 156 such that the corresponding electrode unit 157 with the rectangular iron frame 159 is slidably moved into/out of the opening 152. The decomposed gas harm eliminating device 3*b* has a plurality of inspection openings 160 provided above subchambers 110*b*, 110*e* and 110*g* in FIGS. 9 and 10 and open in the upper surface thereof. The inspection openings 160 provide access for inspection and, if necessary, replacement of the second balls 140, and inspection of the refractor concrete block.

The form of the decomposed gas flow paths is freely designable and can be, for example, straight or zigzag, depending on the kinds and concentration of harmful substances contained in the decomposed gases and the quantities of the wastes to be decomposed. The number of subchambers filled with the second balls 140, and the quantity of second balls 140 may be adjusted appropriately. While in the present embodiment the decomposed gas flow paths are illustrated as extending horizontally, in an alternative, they may extend vertically.

A plurality of decomposed gas harm eliminating devices 3*b* may be attached to the thermal decomposition apparatus 3*a* depending on the quantities of wastes to be decomposed and the quantities of decomposed gases to be produced.

Thus, this invention can be applied to facilities which treat of a large amount of wastes.

A method of thermally decomposing wastes, using the thermal decomposition apparatus 3, will be described next. The door 22 of the thermal decomposition device 3*a* of the thermal decomposition apparatus 3 is opened, and the wastes are then input into the heating chamber 10 so as to placed over the plurality of balls 40. The vacuum pump 151 is then activated to evacuate the heating chamber 10 of the thermal decomposition device 3*a* and the decomposed gas heating chamber 110 of the decomposed gas harm eliminating device 3*b* to bring about a vacuum environment (for example, of either a high vacuum of about $6.7\times10^{-2}$ Pa or a lower vacuum of about 0.02–0.06 MPa). Thus, the plurality of balls 40 within the heating chamber 10 and the plurality of second balls 140 within the decomposed gas heating chamber 10 are also placed in the vacuum environment.

A required voltage is then applied across each pair of carbon electrodes 30 and each pair of carbon electrodes 130 to cause electric discharges among the plurality of balls 40 and among the plurality of second balls 140, respectively. The plurality of pairs of carbon electrodes are connected in series with a power supply (not shown). In an alternative, the electrodes may be connected in parallel with the power supply. However, the series connection of the plurality of pairs of carbon electrodes desirably brings about a higher discharge efficiency and a higher temperature.

Since the discharge regions are at a high temperature of about 3000° C, the wastes are thermally decomposed into gases as in the first embodiment. The decomposed gases are discharged from the outlet port 21 and fed through the connecting pipe 101 to the inlet port 120 into the decomposed gas heating chamber 110 of the decomposed gas harm eliminating device 3*b*.

The introduced decomposed gases come into contact with the electric discharges (sparks) occurring between the plurality of second balls 140 to be heated to a high temperature of about 3000° C. Thus, when hydrocarbon compounds, carbon dioxide and harmful substances such as dioxin are contained in the decomposed gases, they are thermally decomposed into harmless gases, which may contain remaining hydrocarbon compounds and/or the harmful substances or metals. However, these substances are adsorbed by the filter 150 or Bincho charcoal filter 158 an hardly discharged out of the thermal decomposition apparatus 3 to the outside.

The decomposed gas harm eliminating device 3*b* may comprise at least one of (a) a second vacuum meter (not shown) for measuring the pressure within the decomposed gas heating chamber 110 and second pressure adjusting means (not shown) for adjusting to a predetermined value the pressure within the decomposed gas heating chamber 110 based on a measured value of the second vacuum meter; (b) second intervening spacer which contains carbon as a primary ingredient (not shown) provided between the plurality of second balls 140 and at least portions of the inner wall of the decomposed gas heating chamber 110 with which the plurality of second balls 140 would otherwise contact; (c) portions of the inner wall of the decomposed gas heating chamber 110 with which the plurality of second balls 140 contact, and being composed of a monolithic refractory containing at least one selected from the group of boron nitride, niobium, silicon carbide, boron carbide, magnesium oxide, hafnium oxide, hafnium dioxide, and beryllium aluminum oxide; and (d) pairs of second electrodes at least part of which takes the form of a rod or horn (not shown) surrounded by the plurality of second balls 140.

(Fourth Embodiment)

Figure 11:
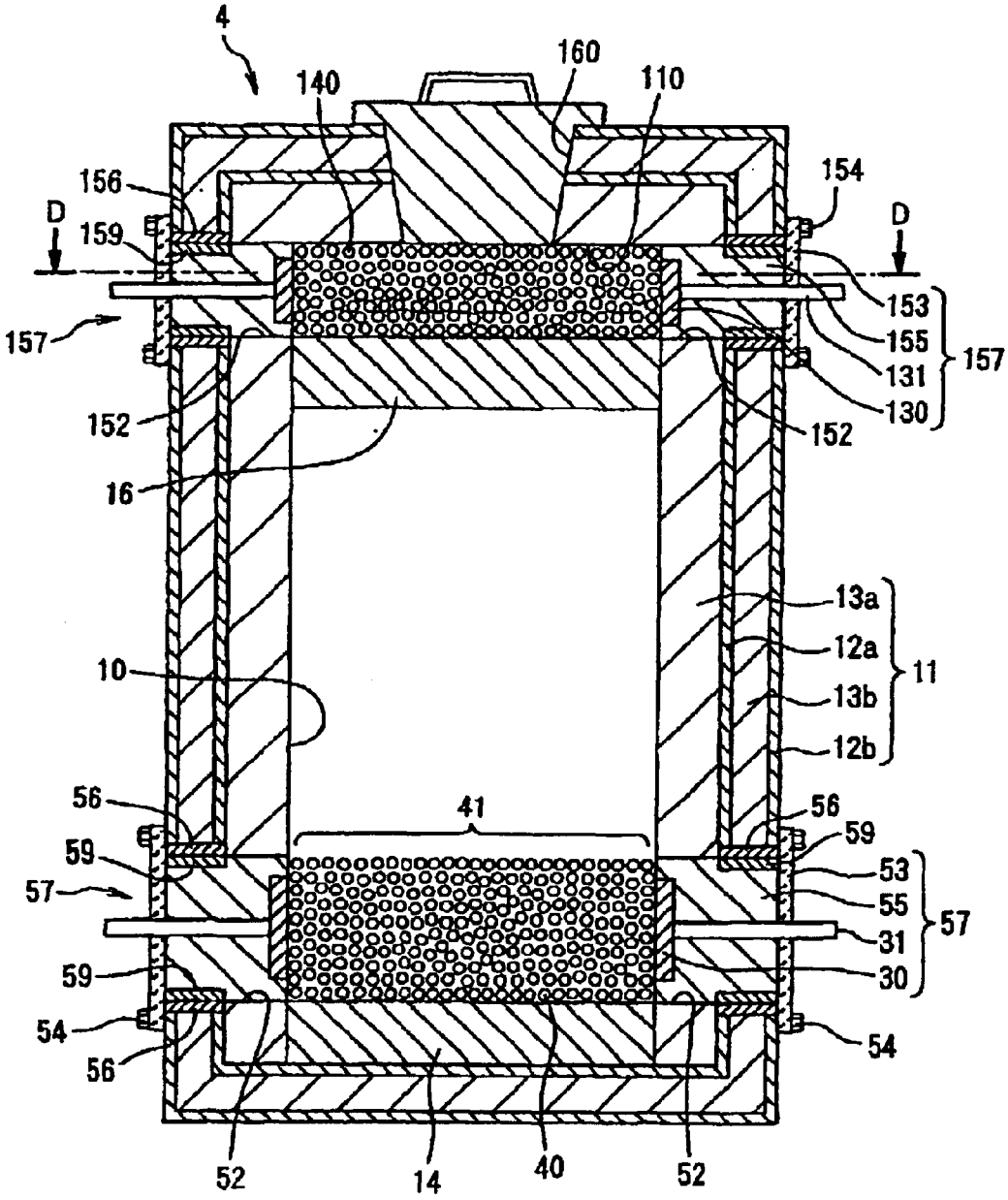
FIG. 11 is a vertical cross-sectional view of a thermal decomposition apparatus for wastes as a fourth embodiment.
Figure 12:
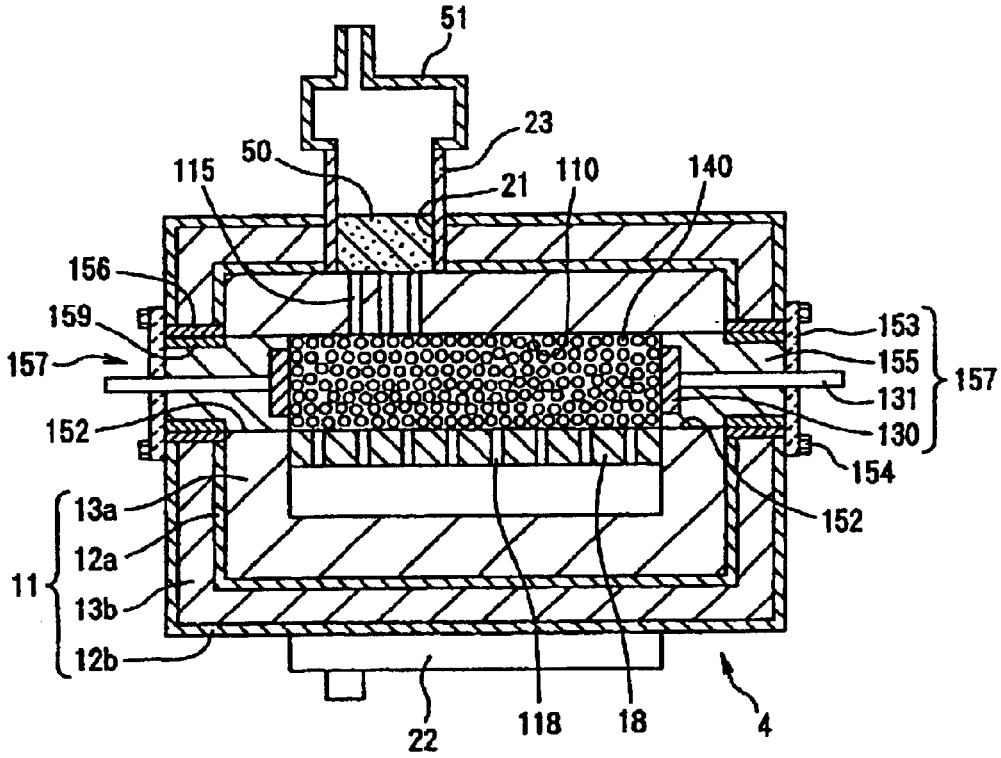
FIG. 12 is a cross-sectional view of the thermal decomposition apparatus taken along a line D—D of FIG. 11.

FIG. 11 is a vertical cross-sectional view of a thermal decomposition apparatus 4 for wastes as a fourth embodiment as viewed from its front. FIG. 12 is a horizontal cross-sectional view taken along a line D—D of FIG. 11. The same reference numeral is used to denote identical or similar elements of the thermal decomposition apparatus 1, 3 and 4 of the first, third and fourth embodiments.

The thermal decomposition apparatus 4 of the fourth embodiment comprises the thermal decomposition device 3*a* and the decomposed gas harm eliminating device 3*b* of the third embodiment combined as a unit and is similar in composition to the thermal decomposition apparatus 1 of the first embodiment except that the thermal decomposition apparatus 4 takes the form of a rectangular parallelepiped (the thermal decomposition apparatus 1 of the first embodiment takes the form of two rectangular parallelepipeds stacked one upon the other) and that the heating chamber 10 has a different internal composition. Thus, further description of the identical composition will be omitted and only their different structural portions will be described next.

Provided on top of the heating chamber 10 is a decomposed gas heating chamber 110 partitioned by horizontal and vertical partitions 16 and 18 of a heat-resisting firebrick. The vertical partition 18 has a plurality of holes 118 as inlet ports for the decomposed gas. A portion of the innermost refractory concrete layer 13*a* facing the outlet port 21 has a plurality of holes 115 which places in fluid communication the heating chamber 110 and the outlet port 21 also functioning as an outlet port for harmless gases.

In such arrangement, the decomposed gases produced from the wastes by thermal decomposition are introduced from the heating chamber 10 through the holes 118 into the heating chamber 110, and then through the holes 115 to the outlet port 21 and to the outside of the thermal decomposition apparatus 4.

The sizes and shapes of the holes 115 and 118 are not especially limited if the plurality of second balls 140 does not pass through these holes. If the second balls 140 each takes the form of a sphere, the shape of the cross-section of the holes 115 and 118 each preferably takes the form of a triangle. The holes 115 and 118 each may take the form of a horizontal or vertical slit. For example, instead of using partitions 18 with holes 118, a plurality of ceramic pillars may be arranged in parallel to form a plurality of spaced slit-like holes 118, which serve to increase the opening area of the holes 115 and 118. Thus, use of the plurality of slit-like holes 115 and 118 is preferable when a large amount of decomposed gas flows through the holes.

The heating chamber 110 is filled with the plurality of second balls 140 each in the shape of a sphere. Thus, they are in point contact one with another. A second light emitting heater includes the plurality of second balls 140.

A pair of second electrodes consisting of two plate-like carbon electrodes 130 are each disposed on both ends of the decomposed gas heating chamber 110 (provided in an upper portion of the heating chamber 10) filled with the second balls 140. Each carbon electrode 130 has a carbon rod 131 attached thereto extending axially outward through the corresponding outer wall 11 of the decomposition apparatus 4. The carbon rod 131 may be replaced with a heat resistant refractory stainless steel rod. It is to be noted that if a stainless steel rod extends through the corresponding carbon electrode 130 so as to be in contact with the second balls 140, the portion of the stainless steel rod in contact with the second balls 140 should be covered with a carbon material so as to prevent its deterioration.

An opening 152, similar to the opening 52 provided for each of the pair of carbon electrodes 30 is provided for each of a pair of carbon electrodes 130 in the decomposition apparatus 4 for inspection and maintenance of the inside of the heating chamber 110 (inspection of any deterioration of the second balls 140 and the carbon electrode 130 and replacement thereof).

Each ceramic cover 153 is fixed with bolts 154 to the outer wall 11 through a refractory sheet (or seal) (not shown) so as to cover a corresponding opening 152 to thereby maintain sufficiently the inner airtightness of the decomposition apparatus 4. Since each refractory concrete block 155 is fitted between the corresponding carbon electrode 130 and the ceramic cover 153, the temperature within the decomposition apparatus 4 is sufficiently maintained. Each ceramic cover 153 may be replaced with an iron cover coated with an insulating material. The refractory concrete block 155 may be replaced with a refractory firebrick block.

Each ceramic cover 153, a corresponding refractory concrete block 155, a corresponding carbon electrode 130, and a corresponding carbon rod 131 compose a united electrode unit 157. Thus, replacement of an old or defective electrode unit 157 is simplified.

A rectangular iron frame 156 is provided so as to fit fixedly into an edge of the corresponding opening 152 at its edge to thereby cover a corresponding portion of the refractory concrete layer 13*b*. A rectangular iron frame 159 fits fixedly over an outer axial end portion of the refractory concrete block 155 and also fits in the rectangular iron frame 156 such that the corresponding electrode unit 157 with the rectangular iron frame 159 is slidably moved into/out of the opening 152.

The decomposition apparatus 4 has an inspection opening 160 provided above the heating chamber 110 and open in the upper surface. The inspection opening 160 provides access for inspection and, if necessary, replacement of the second balls 140 and inspection of the refractory concrete block.

The composition of the heating chamber 110 and the quantity of the second balls 140 may be adjusted depending on the kinds and concentrations of harmful substances contained in the decomposed gases and the quantity of wastes to be decomposed.

A portion of the thermal decomposition apparatus 4 corresponding to the decomposed gas harm eliminating device 3*b* may comprise at least one of the same elements (a)–(d) as were described above with respect to the decomposed gas harm eliminating device 3*b* of the third embodiment.

A method of thermally decomposing the wastes, using the thermal decomposition apparatus 4, will be described next. The door 22 of the thermal decomposition apparatus 4 is opened, and the wastes are then cast into the heating chamber 10 so as to placed over the plurality of balls 40. The vacuum pump 51 is then activated to evacuate the thermal decomposition apparatus 4 to bring about a vacuum environment (for example, of either a high vacuum of about $6.7\times10^{-2}$ Pa or a lower vacuum of about 0.02–0.06 MPa). Thus, the plurality of balls 40 within the heating chamber 10 and the plurality of second balls 140 within the decomposed gas heating chamber 110 are also placed in the vacuum environment.

A required voltage is applied cross each of the first and second pairs of carbon electrodes 30 and 130 to cause electric discharges among the plurality of first balls 40 and among the plurality of second balls 140. The respective discharge regions are at a high temperature of about 3000° C. and hence the wastes are thermally decomposed into gases as in the first embodiment and introduced through the respective groups of holes 118 into the decomposed gas heating chamber 110. The discharge regions occurring between the plurality of second balls 140 are also at a high temperature of about 3000° C. and the decomposed gases in contact with the discharge regions are also heated to about 3000° C. Thus, even when hydrocarbon compounds, carbon monoxide, and harmful substances such as dioxin remain in the decomposed gases, they are thermally decomposed into harmless gases.

Furthermore, the harmless gases pass through the holes 115 to the filter 50. Thus, even when hydrocarbon compounds and harmful substances still remain in the harmless gases, or even when the harmless gas contains metals, they are adsorbed by the filter 50 without being discharged out of the thermal decomposition apparatus 4, leaving only harmless low molecular-weight substances discharged out of the apparatus 4.

A small compact thermal decomposition apparatus for wastes in which the thermal decomposing device and the decomposed gas harm eliminating device are combined as a unit is greatly suitable for use in small-scaled facilities which discharge a small amount of general wastes.

(Fifth Embodiment)

Figure 13:
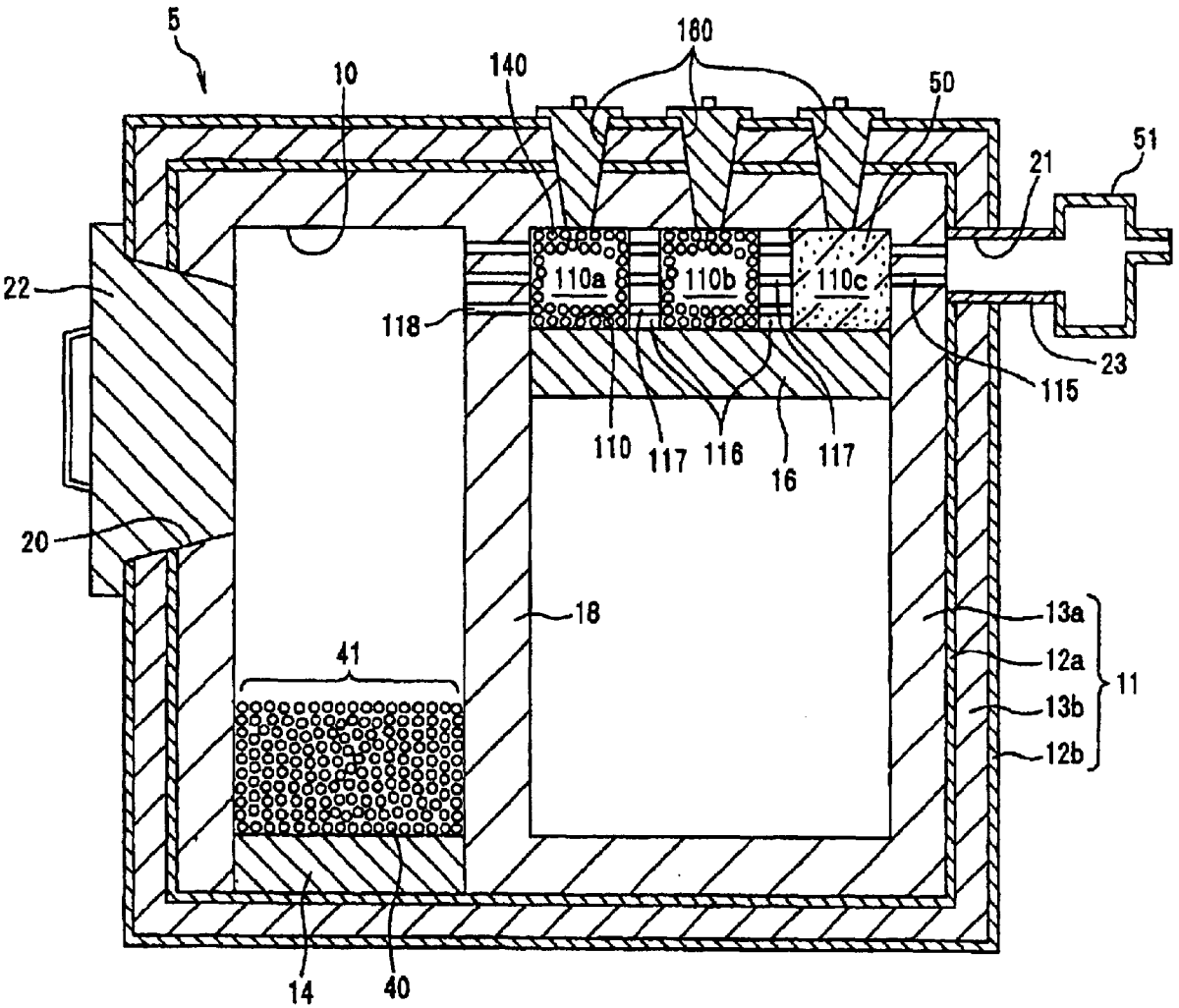
FIG. 13 is a vertical cross-sectional view of a thermal decomposition apparatus for wastes as a fifth embodiment.

FIG. 13 is a vertical cross-sectional view of a thermal decomposition apparatus 5 for wastes as a fifth embodiment as viewed from its side. The same reference numeral is used to denote identical or similar elements of the thermal decomposition apparatus 5, 1, 3 and 4 of the first, third and fourth embodiments.

The thermal decomposition apparatus 5 of the fifth embodiment comprises the thermal decomposition device 3*a* and the decomposed gas harm eliminating device 3*b* of the third embodiment combined as a unit as in the fourth embodiment and is similar in composition to the thermal decomposition apparatus 4 of the fourth embodiment except that the thermal decomposition apparatus 5 is of a larger-scaled type and that the heating chamber 10 has a different internal arrangement. Thus, further description of any identical arrangement will be omitted and only their different structural portions will be described next.

Provided on top of the heating chamber 10 is a decomposed gas heating chamber 10 partitioned by horizontal and vertical partitions 16 and 18 of a heat resistant firebrick as in the decomposition apparatus 4 of the fourth embodiment. The vertical partition 18 has a plurality of holes 118 as inlet ports for the decomposed gas. A portion of the innermost refractory concrete layer 13*a* facing the outlet port 21 has a plurality of holes 115 which place in fluid communication the heating chamber 10 and the outlet port 21 which also functions as an outlet port for harmless gases.

The decomposed gas heating chamber 10 is separated by a plurality of (2 in FIG. 13) spaced partitions 116 of a refractory firebrick into a plurality of (3 in FIG. 13) subchambers 110*a*, 110*b*, 110*c* arranged longitudinally (left to right in FIG. 13) within the apparatus 5. The foremost subchamber 110*a* (the left one in FIG. 13) is in fluid communication through holes 118 with the heating chamber 10 whereas the rearmost subchamber 110*c* is in fluid communication through holes 115 with the outlet port 21. Each partition 116 has a plurality of holes 117 provided at equal intervals through its length so as to place adjacent subchambers in fluid communication.

In such arrangement, the thermally decomposed gases produced from the wastes are introduced from the heating chamber 10 through the holes 118 into the decomposed gas heating chamber 110, and thence pass through the subchamber 110*a*, holes 117, subchamber 110*b*, holes 117, subchamber 110*c*, holes 115, and then discharge from the outlet port 21 to the outside.

The subchambers (110*a*, 110*b* in FIG. 13) other than the rearmost subchamber 110*c* are filled with a plurality of second balls 140 each in the shape of a sphere, with the balls in point contact one with another. A second light emitting heater consists of the plurality of second balls 140.

The rearmost subchamber 110*c* is filled with a fiber-like active carbon filter 50. It is to be noted that no active carbon filter is provided within the exhaust pipe 23. The filter 50 may be replaced with a particulate active carbon filter. A filter of a material other than carbon may be used if it has sufficient absorptivity.

The sizes and shapes of the holes 115, 117 and 118 are not limited so long as the second balls 140 do not pass through these holes. If the second balls 140 each take the form of a sphere, the shape of the holes 115, 117 and 118 each preferably have a cross-section of a triangle. The holes 115, 117 and 118 each may take the form of a horizontal or vertical slit. For example, instead of using the partitions 116 with holes 117, a plurality of ceramic pillars may be arranged in parallel to form a plurality of spaced slit-like holes 117, which serve to increase the open area of the holes 115, 117 and 118. Thus, use of the plurality of slit-like holes is preferable when a large amount of decomposed gas flows through them.

A pair of second electrodes consisting of two plate-like carbon electrodes (which are not shown in FIG. 13, but which have a similar composition to the pair of carbon electrodes 130 in the fourth embodiment) are each disposed on a side of each subchamber filled with the second balls 140. Each carbon electrode has a carbon rod (which is not shown in FIG. 13, but which has a similar composition to the carbon rod 131 in the fourth embodiment) attached thereto and extending axially outward through the corresponding outer wall 11 of the decomposition apparatus 5.

In the thermal decomposition apparatus 5 (not shown in FIG. 13), the compositions of the carbon electrodes and rods, electrode units and openings are similar to those of the electrode units 157 and openings 152 of the thermal decomposition apparatus 4 of the fourth embodiment, and further description thereof will be omitted.

The decomposition apparatus 5 has three inspection openings 160 each provided above a respective subchamber 110*a*, 110*b* and 110*c* and open in the upper surface. The inspection openings 160 provide access for inspection and replacement of the second balls 140, and inspection of the refractory concrete blocks.

In the decomposition apparatus 5, the size of the heating chamber 10 may be adjusted depending on the kinds and quantity of the wastes to be decomposed. Furthermore, the number of subchambers each filled with the second balls 140 and the quantity of second balls 140 may be adjusted appropriately depending on the kinds and concentrations of the harmful substances contained in the decomposed gases.

A portion of the thermal decomposition apparatus 5 corresponding to the decomposed gas harm eliminating device 3*b* may comprise at least one of the same elements (a)–(d) as were described above with respect to the decomposed gas harm eliminating device 3*b* of the third embodiment.

A method of thermally decomposing the wastes, using the thermal decomposition apparatus 5, will be described next. The door 22 of the thermal decomposition apparatus 5 is opened, and the wastes are then cast into the heating chamber 10 so as to be placed over the plurality of balls 40. The vacuum pump 51 is then activated to evacuate the thermal decomposition apparatus 5 to bring about a vacuum environment (for example, of either a high vacuum of about $6.7\times10^{-2}$ Pa or a lower vacuum of about 0.02–0.06 MPa). Thus, the plurality of balls 40 within the heating chamber 10 and the plurality of second balls 140 within the decomposed gas heating chamber 110 are also placed in the vacuum environment.

A required voltage is applied cross each of the first and second pairs of carbon electrodes (none of them are shown in FIG. 13) within the heating chambers 10 and 110 to cause electric discharges among the first plurality of balls 40 and among the second balls 140. The respective discharge regions are at a high temperature of about 3000° C. and hence the wastes are thermally decomposed into gases as in the first embodiment and introduced through the respective groups of holes 118 into the decomposed gas heating chamber 110. The discharge regions occurring among the second balls 140 are also at a high temperature of about 3000° C., and the decomposed gases in contact with the discharge regions are also heated to about 3000° C. while the decomposed gases are passing through the subchambers (110*a*, 110*b* in FIG. 13). Thus, even when hydrocarbon compounds, carbon monoxide, and harmful substances such as dioxin remain in the decomposed gases, they are thermally decomposed into harmless gases. Furthermore, the harmless gases pass through the filter 50. Thus, even when hydrocarbon compounds, harmful substances and metals still remain in the harmless gases, they are adsorbed by the filter 50 without being discharged out of the thermal decomposition apparatus 5, and only harmless low molecular-weight substances are discharged out of the apparatus 5.

The large-scaled thermal decomposition apparatus 5 which comprises the thermal decomposition device and the decomposed gas harm eliminating device united as a unit thermally decomposes a large amount of waste compared to the thermal decomposition apparatus 4 of the fourth embodiment. Thus, the thermal decomposition apparatus 5 is greatly suitable for use in facilities (an eating house or restaurant, hospital or factory) which produce a large amount of waste compared to general households.

The thermal decomposition apparatus 5 may be further increased in size. In this case, it is capable of disposing of a large amount of wastes, so that it is suitable for use in facilities (for example, a large-scaled factory) which discharge a large amount of wastes.

(Sixth Embodiment)

In the thermal decomposition apparatus 1–5 of the first–fifth embodiments, at least portions of the inner walls (made of the refractory concrete layer 13*a* and the heat-resisting refractory firebrick layer 14) of the heating chamber 10 or at least portions of the inner walls (the refractory concrete layer 113*a* and heat resisting firebrick (not shown)) of the heating chamber 110 with which the first or second balls 40 or 140 are in contact may each comprise a plurality of convexities to thereby reduce the respective quantities of the first balls 40 or second balls 140.

Figure 14:
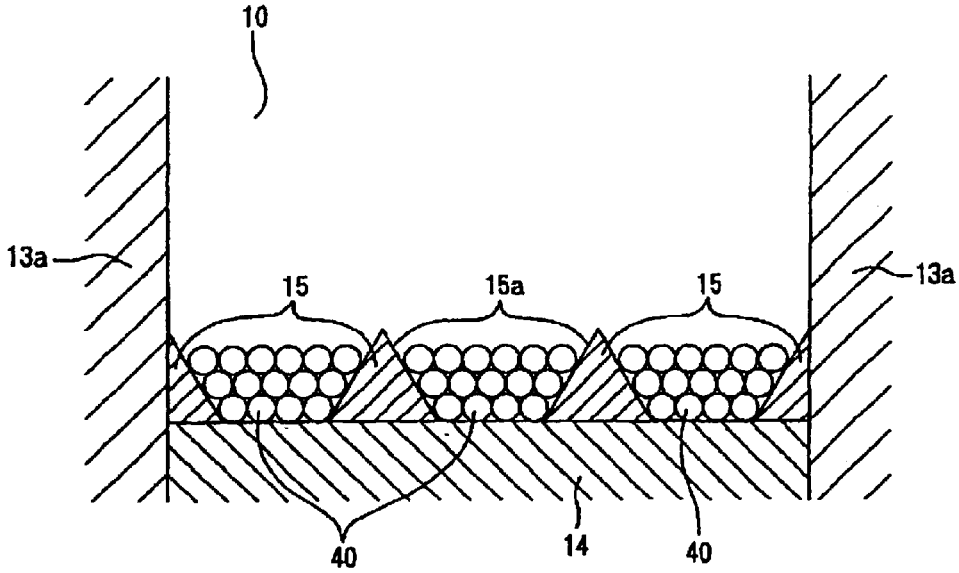
FIG. 14*a* shows a vertical cross-sectional view of a lower portion of a heating chamber of a thermal decomposition apparatus for wastes as a sixth embodiment.
FIG. 14*b* shows a horizontal cross-sectional view of a lower portion of a heating chamber of a thermal decomposition apparatus for wastes as a sixth embodiment.
Figure 14:
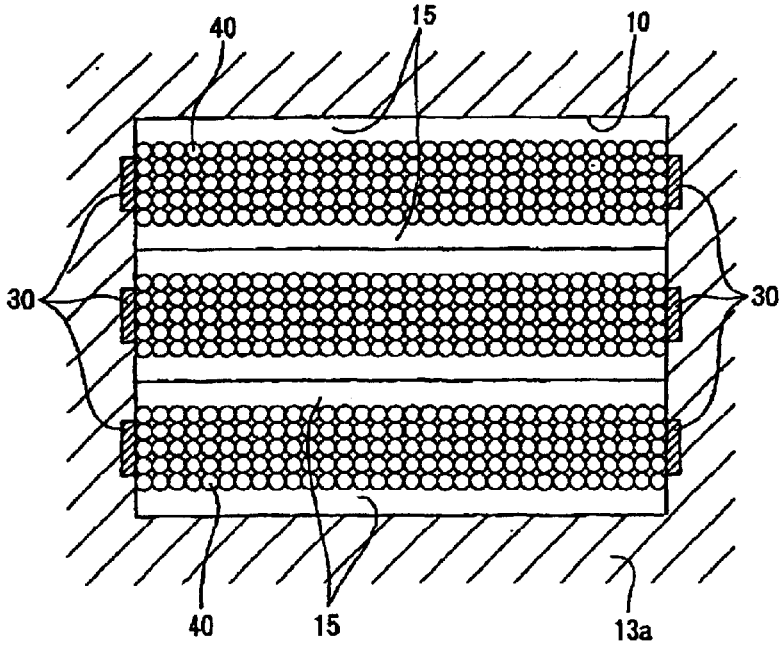

FIGS. 14(*a*) and (*b*) are a vertical cross-sectional view (corresponding to FIG. 3) and a horizontal cross-sectional view, respectively, of a lower portion of the heating chamber 10 of the thermal decomposition apparatus 1–5 for wastes. The same reference numeral is used to denote the identical or similar elements of the first and sixth embodiments.

The thermal decomposition apparatus of this embodiment is similarly in composition to that of the first embodiment and further description of the identical or similar structural elements thereof will be omitted and only different structural portions thereof will be described next.

The heating chamber 10 has on its bottom (made of a heat resistant refractory firebrick layer 14) a plurality of equally spaced parallel convex spacers of a triangular cross-section 15 extending by a length equal to a related pair of electrodes 30 perpendicular to the surfaces of the pair of carbon electrodes 30.

A plurality of balls 40 are disposed in groups between the respective parallel spacers 15. The number of balls 40 is reduced due to fact that the plurality of balls 40 are divided by the spacers 15 into a plurality of groups, and the use of the inclined surfaces 15*a* of the spacers 15. Thus, a quantity of electric power is reduced providing a savings in operating costs.

The spacers 15 may have the same quality as the inner wall of the heating chamber 10 (refractory concrete or heat resistant refractory firebrick) or carbon such as high density impermeable carbon or graphite. If the spacers 15 produce effects such as were mentioned above, the shape of the spacers 15 is not limited to a triangle in cross section.

(Seventh Embodiment)

A thermal decomposition apparatus 7 of this embodiment comprises a group of intervening pillar-like impermeable carbon spacers 19 of a semicircular cross section provided, respectively, between the inner wall (of the refractory concrete layer 13*a* and heat resistant refractory firebrick layer 14) of the heating chamber 10 and the plurality of balls 40 or between the inner wall (of the refractory concrete layer 113*a* and heat resistant refractory firebrick layer (not shown)) of the heating chamber 110 and the plurality of second balls 140 in the relevant thermal decomposition apparatus 1–5 of the first–fifth embodiments. Thus, the plurality of balls 40 or 140 are not in contact with the inner wall of the heating chambers 10 or 110, so that the probability that the inner walls of the heating chambers will be deteriorated or melted due to high temperatures produced from the plurality of balls 40 or 140 is reduced.

The intervening spacers 19 each may take the form of a pipe of a semicircular cross section or the form of a plate so as to cover a portion of the inner wall of the heating chambers with which the plurality of balls 40 or 140 would otherwise contact.

Figure 15:
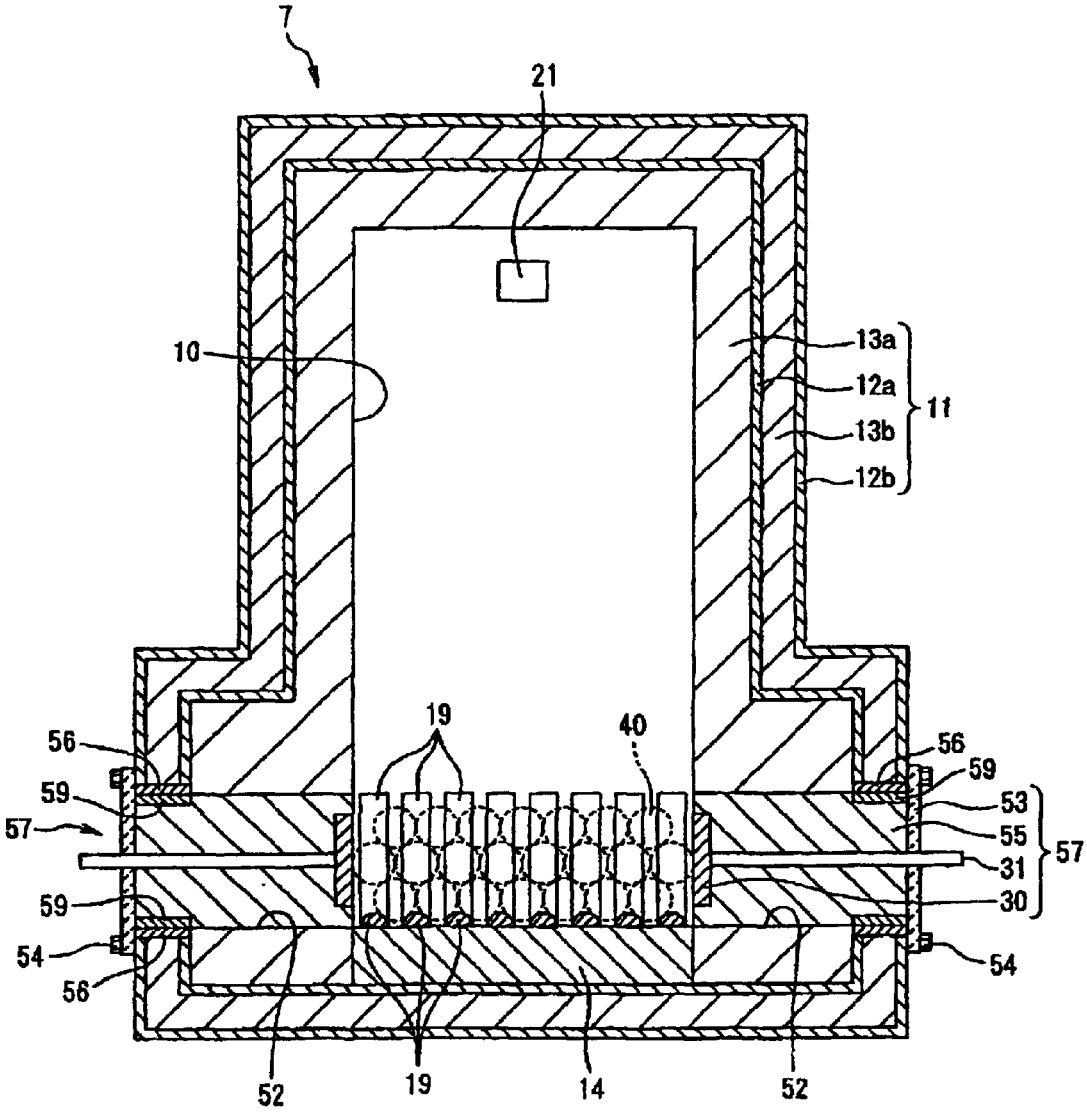
FIG. 15 is a vertical cross-sectional view of a thermal decomposition apparatus for wastes as a seventh embodiment.

FIG. 15 is a vertical cross-sectional view of the thermal decomposition apparatus 7. The same reference numeral is used to denote the identical or similar elements of the thermal decomposition apparatus of the first and seventh embodiments.

The thermal decomposition apparatus 7 of the present embodiment is similar in arrangement to that of the first embodiment, and further description of the same similar structural portions thereof will be omitted and only different structural portions thereof will be explained next.

A plurality of intervening spacers 19 having a semicircular cross section are provided at predetermined intervals parallel to, and between, the surfaces of a pair of plate-like carbon electrodes 30 on the bottom (of a heat resistant refractory firebrick 14) of the heating chamber 10. A second plurality of intervening spacers 19 having the same cross section are disposed perpendicular to the bottom of the heating chamber 10 along its lower inner portion (with which the plurality of balls 40 would otherwise contact) at the predetermined intervals between the pair of carbon electrodes 30 such that their flat surfaces are in contact with the inner wall or bottom of the heating chamber 10 with their cylindrical surfaces facing the heating chamber 10. The interval between any adjacent intervening spacers 19 is smaller than the diameter of one of the balls 40 used.

The spacers 19 are each made of high-density impermeable carbon and graphite.

The spacers 19 may be disposed perpendicular to the surfaces of the pair of plate-like carbon electrodes 30.

The spacers 19 may include pillars of a circular cross section buried partly in the inner wall and bottom of the heating chamber 10 such that they protrude in ½–⅔ of their diameter into the heating chamber 10.

As described above, the plurality of intervening spacers of a semicircular cross section 19 are provided between the inner wall of the heating chamber 10 and the plurality of balls 40 to separate the inner wall and bottom of the heating chamber 10 from the plurality of balls 40. Thus, there is a very low probability that the inner wall and bottom of the heating chamber 10 will be deteriorated and/or melted by heat.

Since the intervening spacers 19 each have a circular surface, they are in point contact with the plurality of balls 40. Thus, no general electrically conductive state occurs, and, therefore, electric discharges with high efficiency are achieved.

In addition, since the intervening spacers 19 in contact with the plurality of balls 40 are each made of high density impermeable carbon and graphite, even when the light emitting heater 41 is heated to about 5000° C. or beyond 3000° C. the spacers 19 withstand that temperature.

The spacers 19 may be made of refractory concrete or heat resistant refractory firebrick as is the material of the inner wall of the heating chamber 10. However, it has a heat resistance only up to about 3000° C.

In the present embodiment a voltage applied first is 400–500 V to thereby feed high power to the light emitting heater 41 to thereby increase their temperature to 5000° C. rapidly, at which temperature almost all materials and gases are decomposed to leave nothing, including ash which includes the remains in general incinerators. Since the decomposition speed is high, a large amount of waste is decomposed continuously. Once the heating chamber reaches 5000° C., the voltage can be reduced to about 30 V applied across the pairs of carbon electrodes and hence operation costs of the decomposition apparatus 7 are low.

Even when the light emitting heater 41 is heated to a high temperature of about 5000° C., the heating chamber 10 is in an oxygen free or vacuum environment. Thus, a position at a distance of about 20–30 cm from the light emitting heater 41 is at a very low temperature and hence there is no need for cooling the thermal decomposition apparatus 7.

Without being tied to any theory, it is believed that the invention effectively uses the physical property of superconductivity that carbon and graphite exhibit at ultrahigh temperatures.

By applying the structures of the inner wall and bottom of such heating chamber 10 to the decomposed gas harm eliminating device 3*b*, the decomposed gases are made harmless efficiently.

A thermal decomposition apparatus 7 may be operated in a manner similar to that mentioned above in a state where a light emitting heater unit comprising the plurality of spacers 19 and the plurality of balls 40 as a unit is disposed between the pair of carbon electrodes 30.

Figure 16:
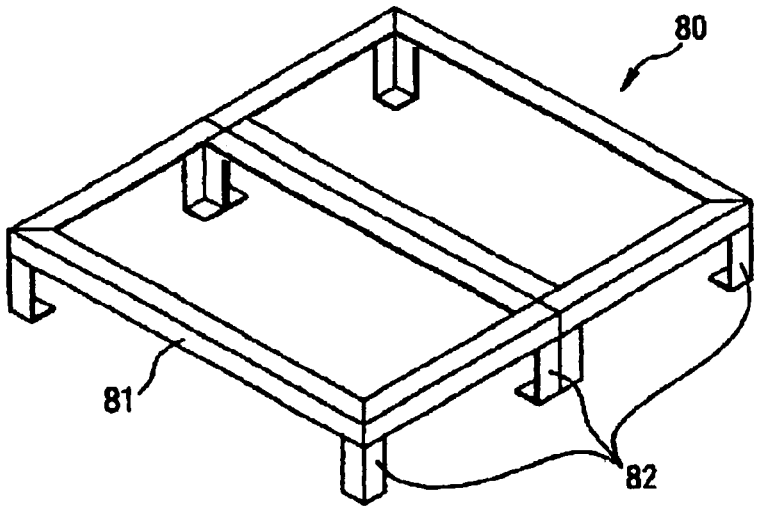
FIG. 16 is a perspective view of a mount for the light emitting heater unit.
Figure 17:
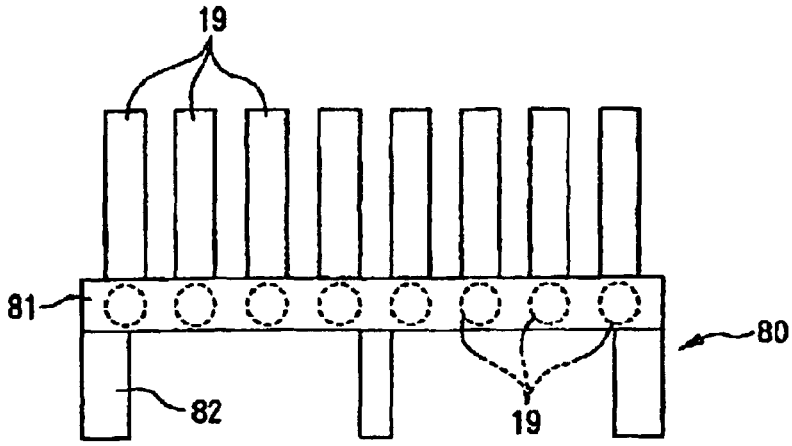
FIG. 17*a* shows a side view of the mount to which intervening spacers are fixed.
FIG. 17*b* shows a plan view of the mount to which intervening spacers are fixed.
Figure 17:
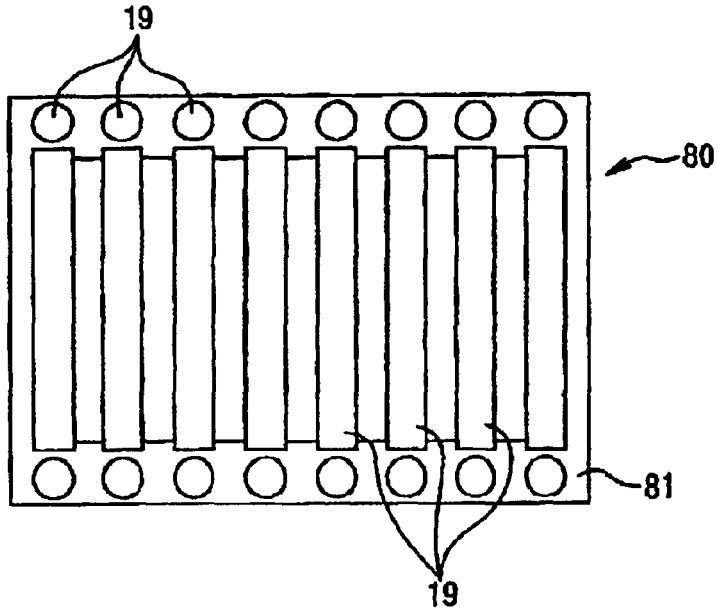

An example of such arrangement will be described with reference to FIGS. 16 and 17. FIG. 16 is a perspective view of a mount 80 on which the plurality of intervening spacers 19 are to be fixed. FIGS. 17(*a*) and (*b*) are a side view and a plan view of the mount 80 on which two groups of spacers 19 are fixed.

The mount 80 includes a rectangular frame 81 which has downward extending legs 82. Additional legs 82 may be provided at corresponding midpoints of respective sides of the frame 81.

A plurality of horizontally extending intervening spacers 19 of a circular cross section are fixed at predetermined intervals across a pair of parallel sides of the frame 81. A second pair of upward extending intervening spacers 19 are fixed at their lower ends parallel to each other to the pair of parallel sides of the frame 81. The interval between any adjacent spacers 19 should be smaller than the diameter of each of the balls 40. Each spacer 19 may have a semi-circular cross section. A plurality of balls 40 are placed on the plurality of horizontally extending spacers 19 fixed on the mount 80 in a space surrounded by the second plurality of spacers 19 to form a united light emitting heater unit comprising the plurality of balls and the first and second plurality of spacers.

Since the plurality of balls 40 are surrounded by the intervening spacers 19 disposed on the bottom and periphery of the mount 80, the plurality of balls 40 are not in contact with the inner wall or bottom of the heating chamber 10, which therefore are prevented from deterioration and/or melting by the heat produced within the heating chamber 10.

Since the respective spacers 19 each have a circular cross section, they are in point contact with the balls 40. Thus, no regular electric conduction occurs, resulting in electric discharges with high efficiency.

If the thermal decomposition apparatus 7 further has an opening in its front for moving the light emitting heater unit into and out of the heating chamber in addition to the openings 52 each provided on opposite sides of the decomposition apparatus 7, facilitating replacement of the plurality of balls 40. In addition, the advantageous design provides for cleaning a small amount of remains and repair, inspection and replacement of the light emitting heater unit and the electrode unit 57.

The intervening spacers 19 are each made of high-density impermeable carbon and graphite. The material of the mount 80 is not limited as long as it has sufficient heat resistance. A simple iron plate will suffice for the mount 80 and hence repair, inspection and/or replacement of the light emitting heater unit is easily performed.

(Eighth Embodiment)

Figure 18:
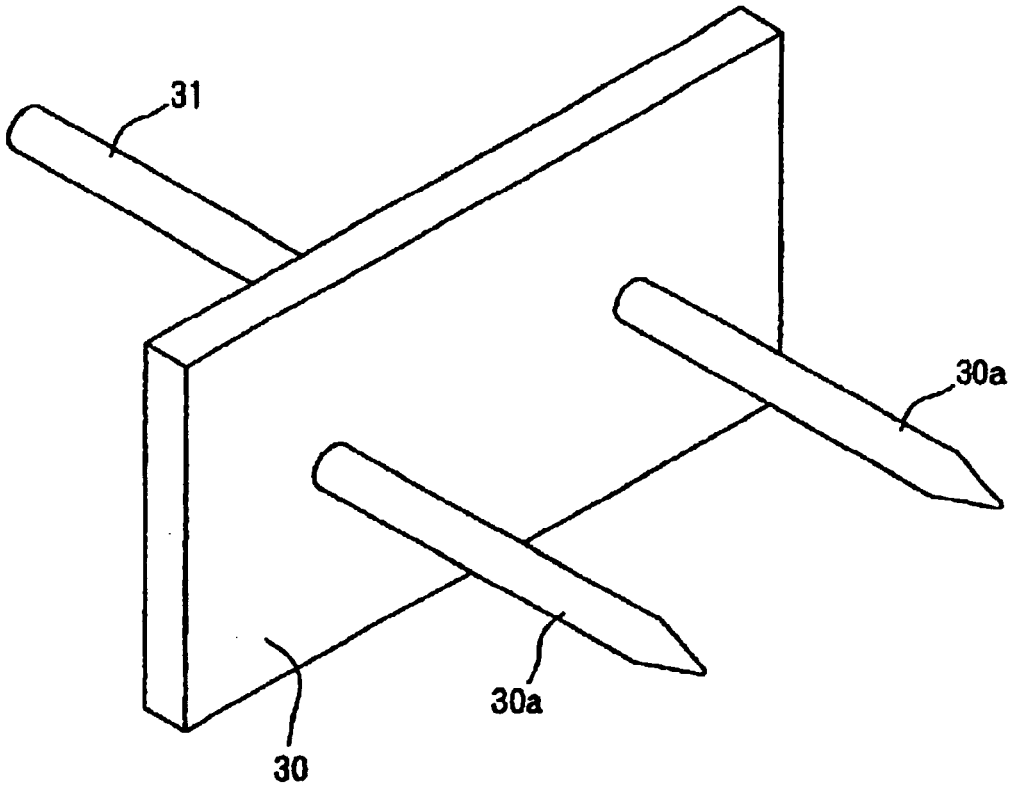
FIG. 18 is a perspective view of a carbon electrode to which a pair of spaced horn electrodes are attached.

A thermal decomposition apparatus of this embodiment comprises a combination of each of the thermal decomposition apparatus 1–5 and 7 of the first–seventh embodiments with a plurality of pairs of horn-like or sharp-tipped rod electrodes 30*a*/130*a* each pair of horn electrodes 30*a*/130*a* being provided on a respective one of the corresponding pair of plate-like carbon electrodes 30/130 so as to extend axially inward perpendicular to the corresponding surface of the carbon electrode 30/130. FIG. 18 is a perspective view of a pair of horn electrodes 30*a* attached to a carbon electrode 30.

In such arrangement, the number of points where the first/second plurality of balls 40/140 are in contact with the corresponding electrodes 30/130 increases to thereby increase the discharge efficiency and hence to obtain a high temperature of about 3000° C. in a shorter time than the other embodiments.

The horn-like or sharp-tipped electrodes 30*a*/130*a* may be replaced with corresponding polygonal pillar-electrodes although the latter is somewhat inferior in point contact compared to the former. The electrodes 30*a*/130*a* are not necessarily required to have a sharp tip but may take the form of a rod. Although a pair of horn electrodes 30*a*/*i* 30*a* are preferably attached perpendicular to the corresponding surface of a plate-like carbon electrode, they are not necessarily required to be so. The number of horn electrodes 30*a*/130*a* to be attached to one plate electrode is not limited, but preferably is about 1–5. The horn electrodes 30*a*/130*a* are usually made of the same in material as the carbon electrodes 30/130.

Ninth Embodiment)

A thermal decompositions apparatus of this embodiment comprises an improvement to the thermal decomposition apparatus 1–5 and 7 of the first–eighth embodiments which in turn comprises at least portions of the inner walls (refractory concrete layer 13*a* and heat resistant firebrick 14) of the heating chamber or at least portions of inner walls (refractory concrete layer 113*a* and heat resistant firebrick (not shown)) of the heating chamber 110, with which the plurality of balls 40 or 140 contact and are composed of a monolithic refractory (refractory concrete or heat resistant firebrick) containing boron nitride.

Boron nitride has a melting point of 3000° C. and is an electrical insulator at high temperatures. Thus, the portions of the inner walls of the heating chamber 10 or 110 with which the plurality of balls 40 or 140 contact have improved heat resistance such that they resist deterioration/melting even at a high temperature of about 3000° C.

The monolithic refractory contains a material selected from the group consisting of boron nitride, niobium, silicon carbide, boron carbide, magnesium oxide, hafnium oxide, hafnium dioxide, and beryllium aluminum oxide.

A method of making, and a physical property of, first and second pluralities of balls 40 and 140 each made of graphite, and used in the above respective embodiments, will be described next in detail.

EXAMPLE 1

Fifty five weight parts of phenol resin was mixed with 45 weight parts of acrylic fiber having a length of 0.1–0.5 mm. Instead of the phenol resin, a polydivinyl benzene resin may be used. Instead of acrylic fiber, animal/plant fibers or a mixture of acrylic fibers and animal/plant fibers may be used. Those fibers such as the acrylic fibers were carbonized in the process of making the balls for the light emitting heater to become carbon fibers within the balls.

The above mixture of phenol resin and acrylic fiber was filled into a mold, and then heated and pressed sufficiently to cure the phenol resin to form spheres (for example, of a diameter of 33 mm). The molding may take the form of a hemisphere, rectangular parallelepiped or pillar. In the case of hemisphere, two hemispheres are joined to form a sphere in this stage. These moldings may have holes or concavities into which desired ingredients are to be injected.

The moldings were then subjected to a flame resistance process at 250–300° C., and then carbonized at 1000–1500° C. under an inert gas. The obtained carbon was then graphitized at 2000–3000° C., and the graphite was then subjected to a sizing process (surface processing).

In the carbonization and graphitization, the half-finished product graphite was burnt repeatedly in an inert gas under an isotropic pressure of not less than 30 MPa in hot isostatic pressing (HIP) to increase the density of the graphite. The HIP is also a method capable of applying isotropic pressure to a sphere.

General graphite or carbon has on its surface and inside many pores, whose total surface is generally about 25% of the whole surface area thereof. By the above-mentioned process, the total area of the pores on the surface and inside of the graphite was reduced to 10% or less of the whole surface area of the graphite and according to circumstances, to 5% or less.

By using a phenol resin as a filler, graphite having a relatively small number of pores was obtained. By further burning this graphite under pressure as described above, impermeable graphite of a higher accuracy was obtained. Impermeable graphite is resistant to corrosion by almost all chemicals in a wide practical range of temperatures. It also had very high thermal conductivity compared to general corrosion resistance materials. It also had a high thermal stability with almost no adverse affects due to rapid changes in the temperature thereof. The quantity of the phenol resin to be added is preferably in a range of 10–60 percent by weight. When the quantity of the phenol resin exceeds 60 percent by weight, the specific gravity of the resulting impermeable graphite is reduced and gas products are liable to be formed within the graphite and/or unhardened gel-like portions are liable to remain within the graphite. In addition, in the carbonization and graphitization, pressure is difficult to apply isotropically to the graphite when phenol resin exceeds 60 percent by weight. If the quantity of the phenol resin is less than 10 weight parts, it is difficult to mold a mixture of the phenol resin and acrylic fibers as a unit. In order to prevent the occurrence of such problems, the quantity of the phenol resin to be added is preferably from about 20–55 percent by weight. It is to be noted that when the thermal shock resistance is considered, the quantity of the phenol resin is only required to be sufficient to harden the acrylic fibers and should be preferably reduced.

This procedure produces balls for light emitting heaters in the form of a sphere and having a diameter of 30 mm. When the products take the form of a rectangular parallelepiped or pillar, they are subsequently ground into balls taking the forms of a sphere.

The balls are made of impermeable graphite, have an absorptivity of not higher than that of rubber, a strength of two-three times that of general graphite, a hardness of not less than 65 (in Example 1, 68), a density of not less than 1.87 g/cm$^3$ (adjustable depending on a ratio in mixture of fibers), a tensile strength of 16.7 MPa, a bending strength of 35.3 MPa, a compression strength of 98.0 MPa, a modulus of elasticity of not less than 12700 MPa, a coefficient of thermal expansion of $3.0\times10^{-6}$/° C., a thermal conductivity of 151 W/m° C., and can withstand temperatures of about 3000° C. For chemical property, they exhibit excellent corrosion resistance to chemicals having a strong acidity such as concentrated sulfuric acid and nitric acid, and chemicals having strong alkalinity such as sodium hydroxide. It is to be noted that when graphite is made from a phenol resin, its alkalinity can be reduced somewhat. Results of a corrosion resistance test are shown in Tables 1–3. The term "all" used in a concentration item of each of Tables 1, 2 and 3 represents "all concentrations".

Since the balls for light emitting heaters are made of impermeable graphite, as described above, they have the following excellent characteristics:

(1) they are resistant to deterioration by the chemicals contained in the harmful substances mentioned above;

(2) they are resistant to oxidation in the atmosphere and oxygen produced by decomposition of the wastes. Thus, they resist deterioration and resist production of carbon monoxide and/or carbon dioxide;

(3) they have a high strength and resist grinding to thereby have an high durability;

(4) they have only a small number of pores, and hence have low adsorption of harmful substances mentioned above. There is low adsorption and hence low desorption at high temperatures;

(5) they exhibit excellent electric and thermal conductivities; and (6) they have high resistance to thermal shocks due to rapid changes in the temperature thereof.

The balls of Example 1 are usable in the air environment. If they are used in a vacuum or oxygen free environment, they exhibit very low oxidation or deterioration, and such an environment is preferable. Especially, in the vacuum state, the discharge efficiency is high and high temperatures are easily obtained with a small amount of power for low operating costs.

TABLE 1

| Chemicals' name [acid] | Concentration (% by weight) | Temperature (° C.) | Corrosion[1] resistance |
|---|---|---|---|
| hydrochloric acid | All | boiling point | A |
| nitric acid | 10~40 | 60 | B |
| hydrofluoric acid | 48 | boiling point | A |
| hydrofluoric acid | 48~60 | 90 | A |
| sulfuric acid | 25~75 | 130 | A |
| phosphoric acid | 85 | boiling point | A |
| phosphoric acid | 96 | 100 | A |
| chromic acid | 10 | 93 | B |
| acetic acid | all | boiling point | A |
| oxalic acid | all | boiling point | A |
| sulfurous acid (sulfurous acid gas saturated) | — | room temp. | A |
| hydrochloric acid (chlorine gas saturated) | 20 | boiling point | A |
| hydrofluoric acid + nitric acid | 5/15 | 93 | A |

[1]A: no corrosion
B: slight corrosion

TABLE 2

| Chemicals' name [alkali] | Concentration (% by weight) | Temperature (° C.) | Corrosion[1] resistance |
|---|---|---|---|
| rayon spinning solution | — | boiling point | A |
| caustic soda aqueous solution | 67 | boiling point | A |
| caustic soda aqueous solution [salt aqueous solution] | 67~80 | 125 | A |
| zinc chloride | All | boiling point | A |
| iron chloride | All | 100 | A |
| sodium chloride | All | boiling point | A |
| sodium hypochloride | 5 | room temp. | A |
| ammonium persulfate | All | 18 | A |
| copper sulfate [halogen] | All | boiling point | A |
| chlorine | 100 | 170 | A |
| chlorine water | Saturated | room temp. | A |

[1]A: no corrosion
B: slight corrosion

TABLE 3

| Chemicals' name [organic compound] | Concentration (% by weight) | Temperature (° C.) | Corrosion[1] resistance |
|---|---|---|---|
| acetone | 100 | boiling point | A |
| ethyl alcohol | 95 | boiling point | A |
| carbon tetrachloride | 100 | boiling point | A |
| ethane tetrachloride | 100 | boiling point | A |
| chloroform | 100 | boiling point | A |
| kerosine | 100 | boiling point | A |
| Dowtherm[2] | 100 | 170 | A |
| benzene | 100 | boiling point | A |
| benzene (saturated with chlorine) | 100 | 60 | A |
| benzyl chloride | 100 | 170 | A |

TABLE 3-continued

| Chemicals' name [organic compound] | Concentration (% by weight) | Temperature (° C.) | Corrosion[1] resistance |
|---|---|---|---|
| methyl alcohol | 100 | boiling point | A |
| monochlorobenzene | 100 | boiling point | A |

[1]A: no corrosion
B: slight corrosion
[2]Heat medium manufactured by the Dow Chemical Co.

EXAMPLE 2

A method of making similar to that of Example 1, except for the materials to be used, and therefore further description of portions of the present method similar to those of the method used for making Example 1 will be omitted, mentioning only the differences of the present method from those of Example 1.

The balls for light emitting heaters in the form of a sphere were made in a manner similar to Example 1 except that graphite powder (99.5% of fixed carbon having an average grain size of 4 $\mu$m) was used instead of the acrylic fibers of Example 1. As an alternative, the graphite powder may be replaced with carbon black powder, coke, charcoal powder such as Japanese Bincho charcoal powder, or a mixture of at least two of those materials.

The balls for light emitting heaters exhibited excellent characteristics similar to those of the balls for light emitting heaters of Example 1.

EXAMPLE 3

A method of making similar to that of Example 1, except for the materials used, and therefore further description of portions of the present method similar to those of the method used for making Example 1 will be omitted mentioning only the differences of the present method from those of Example 1.

Fifty five percent by weight of a phenol resin, 40 percent by weight of graphite powder (including 99.5% of fixed carbon having an average grain size of 4 $\mu$m), and 5 percent by weight of carbon fibers were mixed. As an alternative, instead of the phenol resin, a polydivinyl benzene resin may be used. As an alternative, the graphite powder may be replaced with carbon black powder, coke, charcoal powder such as Japanese Bincho charcoal powder, acrylic fibers, animal or plant fibers or a mixture of at least two selected from those ingredients.

Processing the mixture of the phenol resin, graphite powder and carbon fibers in a manner similar to Example 1, the balls for light emitting heaters of impermeable graphite of high density, and having a reduced number of pores were produced in the form of a sphere.

The balls, thus obtained, had excellent characteristics similar to Example 1 as well as an increased strength due to inclusion of the added carbon fibers.

The phenol resin is preferably in the range of about 10 to about 60 percent by weight. The graphite powder is preferably in the range of about 30 to about 89 percent by weight. The carbon fibers are preferably in the range of about 1 to about 10 percent by weight. The balls for light emitting heater of various characteristics were made in the combination of the respective ranges. When the quantity of the phenol resin exceeds 60 percent by weight, problems such as were described with reference to Example 1 occur. When the quantity of the phenol resin is less than 10 percent by weight, it was difficult to form a molded ball. The phenol resin is more preferably in the range from about 20 to about 25 percent by weight. In terms of heat shock resistance, an added quantity of phenol resin required for hardening the graphite powder will suffice for making Example 3. Addition of a less quantity of phenol resin is more preferable.

When the amount of carbon fiber to be added was less than 1 percent by weight, the strength of the resulting balls was not improved, and when the carbon fiber content 10 percent by weight, cracks occur in the resulting balls. The carbon fiber content is more preferably from about 3 percent to about 7 percent by weight.

EXAMPLE 4

A method of making similar to that of Example 1, except for the materials used and therefore further description of portions of the present method similar to those of the method used for making Example 1 will be omitted mentioning only the differences of the present method from those of Example 1.

Fifty five percent by weight of a phenol resin, 40 percent by weight of graphite powder (including 99.5% of fixed carbon having an average grain size of 4 $\mu$m), and 5 percent by weight of tungsten powder (having an average grain size of about 11.0 $\mu$m, a bulk specific gravity (no load) of 4.22, and a purity of 99.9% or more) were mixed. As an alternative, instead of phenol resin, a polydivinyl benzene resin may be used. As an alternative, the graphite powder may be replaced with carbon black powder, coke, charcoal powder such as Japanese Bincho charcoal powder, acrylic fibers, animal or plant fibers or a mixture of at least two selected from those ingredients. As an alternative, the tungsten powder may be replaced with titanium powder (having an average grain size of about 1.0 $\mu$m, a bulk specific gravity (no load) of 1.5–2.0, and a purity of 99.9% or more) or a mixture of tungsten powder and titanium powder.

Processing the mixture of phenol resin, graphite powder and tungsten powder in a manner similar to that used for making Example 1, produced balls for light emitting heaters of impermeable graphite of high density with a small number of pores and in the shape of a sphere. Unlike Example 1, the balls of the present Example contained tungsten. In addition, the final step of the graphitization included heat treatment of the half-finished products at about 3000° C. in an inert gas.

Tungsten was heated at a temperature of about 3000° C. to form ditungsten carbide ($W_2C$, a formula weight of 379.71, a density of 17.2 g/cm$^3$, a Mohs' hardness of 9, an electric resistance of 81 $\mu\Omega$/cm (25° C.)). Titanium was also heated at a temperature of about 3000° C. to form titanium carbide (TiC, a formula weight of 59.90, a melting point of 3140±90° C., a boiling point of 4300° C. a density of 4.94 g/cm$^3$, and an electric resistance of 193 $\mu\Omega$/cm (at room temperature)). When $W_2C$ was heated at a temperature of not lower than 2400° C., its crystal form became a stable $\beta$ type.

Titanium has a melting point of 1675° C., a boiling point of 3262° C., and a density of 4.54 g/cm3. When it changed to titanium carbide, its melting and boiling points greatly increased and its density increased as well. Tungsten has melting and boiling points of 3387 and 5962° C., respectively.

The balls for light emitting heaters of impermeable graphite containing at least one of ditungsten carbide and titanium carbide had, in addition to the above-mentioned features (1)–(6) of Example 1, corrosion resistance, mechanical strength (a high hardness, a modulus of elasticity of 310000–440000 MPa) and heat resistance (to 3000° C. or more). In addition, the balls had a high electric conductivity (electric resistance of not more than 70 μΩ/cm, (in the present example, 10 μΩ/cm)), and a high electric discharge efficiency. The heat treatment of the half-finished products at about 3000° C. in the inert gas produced the following advantage:

(a) after the heat treatment, the balls for light emitting heaters were not required to be subjected to a finishing process or step such as bright heat treatment for polishing the surfaces of the balls;

(b) the balls after use were substantially unchanged; and (c) the heat treatment caused no pollution to the public.

The phenol resin is preferably in the range from about 10 to about 60 percent by weight; the graphite powder is preferably in the range form about 20 to about 89 percent by weight; and the tungsten powder is preferably in the range from about 1 to 20 percent by weight. The problems, as described in Example 3, occur when the phenol resin is less than 10 percent by weight or greater than 60 percent by weight. When the amount of tungsten powder is greater than 10 percent by weight, the phenol resin is preferably in the range from 20 to 60 percent by weight.

When the amount of tungsten powder to be added was less than 1 weight part, the mechanical properties, corrosion resistance and heat resistance were not substantially improved. When it exceeded 20 weight parts, the mechanical properties conversely deteriorated to thereby cause cracks in the resulting balls or reduce the processability of the balls. In order to improve the mechanical properties, corrosion resistance and heat resistance sufficiently, and to prevent the occurrence of the cracks in the balls and the problems of processability, the amount of tungsten powder is preferably 5–10 percent by weight.

The balls are preferably molded in the shape of spheres. When the balls are molded as hemispheres and the hemispheres joined, problems such as cracking occur. In an alternative, the balls may be molded with the phenol resin and graphite powder, and molded with holes and/or concavities. Subsequent to the ball formation, the holes and/or concavities are filed with tungsten powder and further processed. This is the preferred method when the tungsten powder is between about 10 and 20 percent by weight.

EXAMPLE 5

In this Example, a quantity of graphite powder used is larger than that of phenol resin. This Example is the same as Example 1 except for the ingredients to be used. Thus, further description of the identical portions of Examples 1 and 5 will be omitted and only different portions of Example 5 from Example 1 will be described.

Twenty percent by weight phenol resin, 70 percent by weight graphite powder (including 99.5% of fixed carbon having an average grain size of 4 μm), and 10 percent by weight tungsten powder (having an average grain size of about 1.0 μm, and a purity of 99.9% or more) were mixed. In an alternative, a polydivinyl benzene resin may be used in place of the phenol resin. In an alternative, the graphite powder may be replaced with carbon black powder, coke, charcoal powder such as Japanese Bincho charcoal powder, acrylic fibers, animal or plant fibers or a mixture of at least two selected from those ingredients. In an alternative, the tungsten powder may be replaced with titanium powder or a mixture of tungsten powder and titanium powder.

By processing the mixture of phenol resin, graphite powder and tungsten powder in a manner similar to that used for making Example 4, balls for light emitting heaters of impermeable graphite of high density with a small number of pores were made in the form of a sphere.

The balls, thus obtained, had excellent characteristics similar to those of the balls of Example 4, and with a specific gravity of 1.5–1.8. It is to be noted that when tungsten powder having a specific gravity of 9.0 g/cm$^3$ (pressed under a pressure of 98 MPa) was used, the balls had a specific gravity of 2.66–2.7. In order to apply pressure to the balls to increase their density and thereby improve the impermeability, tungsten powder having a specific gravity of 9.0 g/cm$^3$ is preferably used.

EXAMPLE 6

This Example is the same as Example 1 except for the ingredients to be used. Thus, further description of the identical portions of Examples 1 and 6 will be omitted and only different portions of Example 6 from Example 1 will be described next.

Twenty percent by weight phenol resin, 10–20 percent by weight zirconium powder, and 60–70 percent by weight graphite powder (including 99.5% of fixed carbon having an average grain size of 4 μm) were mixed. In an alternative, instead of phenol resin, a polydivinyl benzene resin may be used. In an alternative, the graphite powder may be replaced with carbon black powder, coke, charcoal powder such as Japanese Bincho charcoal powder, acrylic fibers, animal or plant fibers or a mixture of at least two selected from those ingredients.

A mixture of phenol resin, graphite powder and carbon fibers was then heated to 250–300° C. to cure the phenol resin, and burned in the HIP at 1900° C. (higher than the melting point of 1857° C. of zirconium) to react the carbon and zirconium to form zirconium carbide (ZrC) (having a melting point of 3540° C., a boiling point of 5100° C. and a Mohs' hardness of not lower than 8) of a high density with a small number of pores. It was then further burned at 3000° C. in the HIP to produce balls for light emitting heater of impermeable graphite in the shape of a sphere. When another metal is used instead of zirconium, it is heated to react with carbon to form a metal carbide. Thus, the partially processed products are preferably burned in the HIP at a temperature of not lower than the melting point of the metal.

The balls, thus obtained, had excellent characteristics similar to those of the balls of Example 1 as well as excellent heat resistance due to addition of the zirconium powder.

When the amount of zirconium powder to be added is less than 10 percent by weight, improvements in the heat resistance of the balls do not appreciably occur and when it exceeds 20 percent by weight, cracks are liable to occur in the balls as in Examples 4 and 5.

In an alternative, the zirconium powder may be replaced with niobium (Nb) or boron (B) powder or a mixture of at least two of those three materials. In addition, 10–20 percent by weight at least one of tungsten and titanium powder may be added. A total quantity of these metal ingredients should not exceed 40 percent by weight. Forty percent by weight or more of graphite (carbon black) powder and about 20 percent by weight of phenol resin as a binder are preferably added.

When zirconium and niobium powder were together used, they reacted at high temperatures to produce a product exhibiting properties of superconductivity. Niobium reacted with graphite (carbon black) powder to become niobium carbide which served to improve the heat resistance, hardness and electrical conductivity of the resulting balls for use as light emitting heaters.

While in the Examples described above the materials were illustrated as being heated in a mold and pressed into spheres, they may be heated in a capsule and pressed into a rod, which may then be cut away and ground into spheres. In this case, the capsule which contains the materials is evacuated and heated to cure the phenol resin. The temperature is then increased to 1900° C. or more to burn the capsule under a pressure of 49–294 MPa in the HIP, and further burned at 3000° C. in the HIP.

Even before the stop of burning at 3000° C., the intermediate product is a rod comprising a carbon material of a very high density. Thus, the intermediate product rud may be cut away and then ground into spheres suitable for use as the balls for light emitting heaters with a low porosity.

Although in the case of the method of using the mold, two different steps which include molding the material into spheres and burning the material in the HIP are required to be performed. The method of using such capsule is only required to perform the HIP burning step, economically.

The material of the capsule is not especially limited as long as it does not react with the materials of the balls for light emitting heaters at high temperature. Usually, stainless steel, aluminum and iron are used to form the capsule material.

EXAMPLE 7

An example of making balls for light emitting heaters, using as a binder pitch (petroleum, coal tar or pine pitch), will be explained next.

Graphite powder (which may be replaced with carbon black powder), pitch, metal powder, and a small amount of solvent were mixed and then charged into a column-type capsule of stainless steel, aluminum or iron up to about 80 vol % of the capsule capacity. The capsule was then evacuated to a vacuum state and then burned at 1000° C. Subsequently, the capsule was burned at 1900° C. or more at a pressure of from 49 to 294 MPa for carbonizing purposes. It was then graphitized at 3000° C., and then processed into the balls for light emitting heaters of impermeable graphite of a high density with low porosity.

The quantity of graphite powder used was not less than 40 percent by weight. The metal powder is at least one selected from the group consisting of tungsten, titanium, zirconium, niobium, boron powder, and mixtures thereof. The total amount of metal powder added was 10–20 percent by weight.

Even before the step burning at 3000° C., the intermediate product is a rod comprising a carbon material of a very high density. Thus, the intermediate product rod may be cut away and then ground into spheres suitable for use as the balls for light emitting heaters with a low porosity.

EXAMPLE 8

In the Examples 1–6 the pressurizing and burning steps were illustrated as being performed under a blanket of an inert gas. If nitrogen gas is used as the inert gas, the added metal ingredients are formed into a nitride. Thus, the strength, hardness and discharge resistance of the balls for light emitting heaters are increased.

Similar effects were also obtained by again burning the balls for light emitting heater made in each of Examples 1–7 in a nitrogen gas atmosphere at 1900–2000° c.

What is claimed is:

1. A thermal composition apparatus for waste comprising:

a heating chamber for heating the wastes;

an inlet port for introducing the wastes into said heating chamber;

at least one pair of electrodes provided within said heating chamber;

a light emitting heater consisting of a plurality of balls which contain carbon as a main ingredient, said light emitting heater being provided between said at least one pair of electrodes so as to produce an electric discharge when a voltage is applied across said at least one pair of electrodes; and an outlet port for discharging substantially harmless gases out of said heating chamber;

wherein the wastes have been thermally decomposed into the substantially harmless gasses and further comprising means for decompressing said heating chamber such that said plurality of balls are placed in a vacuum.

2. The thermal decomposition apparatus according to claim 1, wherein said plurality of balls are each made of a material selected from the group consisting of charcoal, graphite, a carbon composite material, and mixtures thereof.

3. The thermal decomposition apparatus according to claim 1, wherein each of said plurality of balls is impermeable.

4. The thermal decomposition apparatus according to claim 1, wherein said plurality of balls each take the form of a sphere.

5. The decomposition apparatus according to claim 1, further comprising means, provided within said heating chamber, for pressing the wastes against said plurality of balls.

6. The thermal decomposition apparatus according to claim 1, further comprising a filter made of a material selected from the group consisting of active carbon, charcoal, and mixtures thereof.

7. The thermal decomposition apparatus according to claim 1, further comprising: a vacuum meter for measuring the pressure within said heating chamber; and means for adjusting the pressure within said heating chamber to a predetermined value.

8. The thermal decomposition apparatus according to claim 1, further comprising an intervening spacer which contains carbon as a main ingredient, the intervening spacer being placed between said plurality of balls and an inner wall of said heating chamber.

9. The thermal decomposition apparatus according to claim 1, wherein at least portions of an inner wall of said heating chamber are placed in contact with said plurality of balls and wherein at least portions of the inner wall are made of a monolithic refractory material selected from the group consisting of boron nitride, niobium, silicon carbide, boron carbide, magnesium oxide, hafnium oxide, hafnium dioxide, beryllium aluminum oxide, and mixtures thereof.

10. The thermal decomposition apparatus according to claim 1, wherein at least a part of the pairs of electrodes may take the form of a rod or horn surrounded by said plurality of balls.

11. The thermal decomposition apparatus according to claim 1, further comprising a pipe for introducing liquid wastes into said heating chamber.

12. The thermal decomposition apparatus according to claim 1, further comprising a decomposed gas harm eliminating device for thermally decomposing harmful materials remaining in the decomposed gases into harmless gases, the decomposed gas harm eliminating device comprising:

a decomposed gas heating chamber for heating the decomposed gases;

a decomposed gas inlet port for introducing the decomposed gases into said decomposed gas heating chamber;

at least one pair of second electrodes provided within said decomposed gas heating chamber;

a second light emitting heater consisting of a plurality of second balls which contain carbon as a main ingredient, provided between said at least one pair of second electrodes so as to produce an electric discharge when a voltage is applied across said at least one pair of second electrodes;

a harmless gas outlet port for discharging harmless gases to which the decomposed gases have been rendered; and a filter comprising a material selected from the group consisting of active carbon, charcoal, and mixtures thereof.

13. The thermal decomposition apparatus according to claim 12, wherein said decomposed gas harm eliminating device further comprises:

a second vacuum meter for measuring the pressure within said decomposed gas heating chamber; and second means for adjusting the pressure within said decomposed gas heating chamber to a predetermined value.

14. The thermal decomposition apparatus according to claim 12, wherein said decomposed gas harm eliminating device further comprises a second intervening spacer which contains carbon as a main ingredient, placed at least between said plurality of second balls and the inner wall of said decomposed gas heating chamber.

15. The thermal decomposition apparatus according to claim 12, wherein said decomposed gas harm eliminating device further comprises at least portions of the inner wall of said decomposed gas heating chamber which are placed in contact with said plurality of second balls being made of a monolithic refractory material selected from the group consisting of boron nitride, niobium, silicon carbide, boron carbide, magnesium oxide, hafnium oxide, hafnium dioxide, beryllium aluminum oxide, and mixtures thereof.

16. The thermal decomposition apparatus according to claim 12, wherein said decomposed gas harm eliminating device further comprises a second pair of electrodes having at least a part thereof in the form of a rod or horn surrounded by said plurality of second balls.

* * * * *